US009720340B2

(12) United States Patent
Tominaga et al.

(10) Patent No.: US 9,720,340 B2
(45) Date of Patent: Aug. 1, 2017

(54) TONER

(71) Applicant: CANON KABUSHIKI KAISHA, Tokyo (JP)

(72) Inventors: Tsuneyoshi Tominaga, Suntou-gun (JP); Yasushi Katsuta, Susono (JP); Katsuyuki Nonaka, Mishima (JP); Taiji Katsura, Suntou-gun (JP); Akane Masumoto, Yokohama (JP); Harumi Takada, Susono (JP); Kohei Mizushima, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 55 days.

(21) Appl. No.: 14/707,770

(22) Filed: May 8, 2015

(65) Prior Publication Data

US 2015/0331344 A1 Nov. 19, 2015

(30) Foreign Application Priority Data

May 14, 2014 (JP) ..... 2014-100911

(51) Int. Cl.
*G03G 9/093* (2006.01)
*G03G 9/087* (2006.01)
*G03G 9/08* (2006.01)

(52) U.S. Cl.
CPC ..... *G03G 9/08797* (2013.01); *G03G 9/0819* (2013.01); *G03G 9/08711* (2013.01); *G03G 9/08755* (2013.01); *G03G 9/08795* (2013.01); *G03G 9/09321* (2013.01); *G03G 9/09364* (2013.01); *G03G 9/09371* (2013.01)

(58) Field of Classification Search
CPC ..... G03G 9/08755; G03G 9/08711; G03G 9/09321; G03G 9/09314; G03G 9/09364; G03G 9/09371; G03G 9/08797
USPC ..... 430/109.4, 109.3, 110.2
See application file for complete search history.

(56) References Cited

U.S. PATENT DOCUMENTS

| | | | | |
|---|---|---|---|---|
| 8,580,471 | B2 | 11/2013 | Owada et al. | |
| 2008/0145775 | A1* | 6/2008 | Vijayendran | C08L 67/025 430/109.3 |
| 2008/0166156 | A1* | 7/2008 | Kawase | G03G 9/0808 399/222 |
| 2011/0305984 | A1* | 12/2011 | Tominaga | G03G 9/09314 430/108.4 |
| 2015/0248071 | A1* | 9/2015 | Katsura | G03G 9/08755 430/109.3 |
| 2015/0248072 | A1 | 9/2015 | Katsuta et al. | |

FOREIGN PATENT DOCUMENTS

| | | | |
|---|---|---|---|
| JP | 2012-145600 | A | 8/2012 |
| JP | 2012-521567 | A | 9/2012 |
| JP | 2012-233037 | A | 11/2012 |
| JP | 2012-255083 | A | 12/2012 |

* cited by examiner

*Primary Examiner* — Janis L Dote
(74) *Attorney, Agent, or Firm* — Fitzpatrick, Cella, Harper & Scinto

(57) ABSTRACT

Provided is a toner that has satisfactory chargeability and hardly causes a reduction in image density, fogging, and density unevenness in various environments ranging from a low-temperature and low-humidity environment to a high-temperature and high-humidity environment. The toner includes toner particles obtained by fixing resin particles to toner base particles each containing resins, in which: the resins contain 50.0 mass % or more of a styrene-acrylic resin and 1.0 to 40.0 mass % of a polyester resin A; the polyester resin A contains 0.10 to 30.00 number % of an isosorbide unit; the fixing amount of the resin particles to the toner base particles is from 0.1 to 5.0 parts by mass with respect to 100 parts by mass of the toner base particles; and the glass transition temperature of the resin particles is higher than the glass transition temperature of the toner base particles.

7 Claims, 2 Drawing Sheets

TONER

BACKGROUND OF THE INVENTION

Field of the Invention

The present invention relates to a toner for developing an electrostatic latent image (electrostatic image) to be used in image forming methods such as electrophotography and electrostatic printing.

Description of the Related Art

In an image forming method based on electrophotography, image formation is performed by developing an electrostatic latent image on the surface of an electrophotographic photosensitive member with charged toner particles. The chargeability of toner needs to be controlled in order that satisfactory image formation may be performed.

In addition, a printer capable of forming an image having additionally high definition has been required in the recent market. Accordingly, the toner has been required to be capable of maintaining not only satisfactory chargeability but also high flowability for achieving high-efficiency development or transfer.

Against such background as described above, investigations have been vigorously made for improving the chargeability and flowability of the toner.

In general, a charge control agent is added to each of toner particles for controlling the chargeability of the toner. However, an investigation has been made on the utilization of the triboelectric charging characteristic of the binder resin of each of the toner particles.

Japanese Patent Application Laid-Open No. 2012-145600 describes a method of improving the electrical characteristics of toner with a polyester resin obtained by the polycondensation of a carboxylic acid component and a polyhydric alcohol component derived from a sugar alcohol. Japanese Patent Application Laid-Open No. 2012-145600 describes an alcohol having an isosorbide unit as one polyhydric alcohol component.

In addition, Japanese Patent Application Laid-Open No. 2012-233037 and Japanese Patent Application Laid-Open No. 2012-255083 each describe a toner improved in fixability, storage stability, and durability by using a polyester resin having an isosorbide unit. In addition, Japanese Patent Translation Publication No. 2012-521567 describes a toner using a polyester resin having an isosorbide unit from the viewpoint of environmental response.

SUMMARY OF THE INVENTION

However, the inventors of the present invention have made extensive investigations, and as a result, have found that when the toner described in Japanese Patent Application Laid-Open No. 2012-145600 is used, a reduction in image density may occur in association with a reduction in chargeability of the toner in a high-humidity environment. The foregoing may result from the high moisture absorbing property of the isosorbide unit.

In addition, the inventors have found that the moisture absorbing properties of the toners described in Japanese Patent Application Laid-Open No. 2012-233037, Japanese Patent Application Laid-Open No. 2012-255083, and Japanese Patent Translation Publication No. 2012-521567 tend to be high because the main resin of each of the toner particles has an isosorbide unit as in the toner described in Japanese Patent Application Laid-Open No. 2012-145600. The inventors have found that the charge quantities of the toners tend to reduce owing to the foregoing tendency.

Further, the inventors have found that even when the flowability of any one of the toners is improved with an external additive, it becomes difficult to maintain the flowability of the toner owing to the effects of the embedding and moisture absorption of the external additive caused by long-term use of the toner, and hence unevenness is liable to occur in an image density.

Because of the foregoing reasons, the fact is that a toner that has satisfactory chargeability and satisfactory flowability, and hardly causes a reduction in image density, fogging, and density unevenness in various environments ranging from a low-temperature and low-humidity environment to a high-temperature and high-humidity environment has been required.

One aspect of the present invention is directed to providing a toner that has satisfactory chargeability and hardly causes a reduction in image density, fogging, and density unevenness in various environments ranging from a low-temperature and low-humidity environment to a high-temperature and high-humidity environment.

According to one aspect of the present invention, there is provided a toner, including toner particles obtained by fixing resin particles to toner base particles each containing resins and a colorant, in which:

the resins include a styrene-acrylic resin and a polyester resin A;

a content of the styrene-acrylic resin is 50.0 mass % or more with reference to the resins;

a content of the polyester resin A is 1.0 mass % or more and 40.0 mass % or less with reference to the resins;

the polyester resin A has a unit represented by the following formula (1), and a ratio of the unit represented by the following formula (1) is 0.10 number % or more and 30.00 number % or less with reference to the number of all units constituting the polyester resin A;

(1)

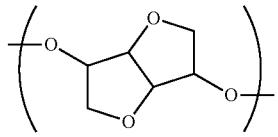

a fixing amount of the resin particles to the toner base particles is 0.1 part by mass or more and 5.0 parts by mass or less with respect to 100.0 parts by mass of the toner base particles; and when a glass transition temperature of the toner base particles is represented by Tg1 (° C.) and a glass transition temperature of the resin particles is represented by Tg2 (° C.), the Tg2 is higher than the Tg1.

According to the one aspect of the present invention, it is possible to provide the toner that has satisfactory chargeability and hardly causes a reduction in image density, fogging, and density unevenness in various environments ranging from a low-temperature and low-humidity environment to a high-temperature and high-humidity environment.

Further features of the present invention will become apparent from the following description of exemplary embodiments with reference to the attached drawings.

DESCRIPTION OF THE EMBODIMENTS

Figure 1:
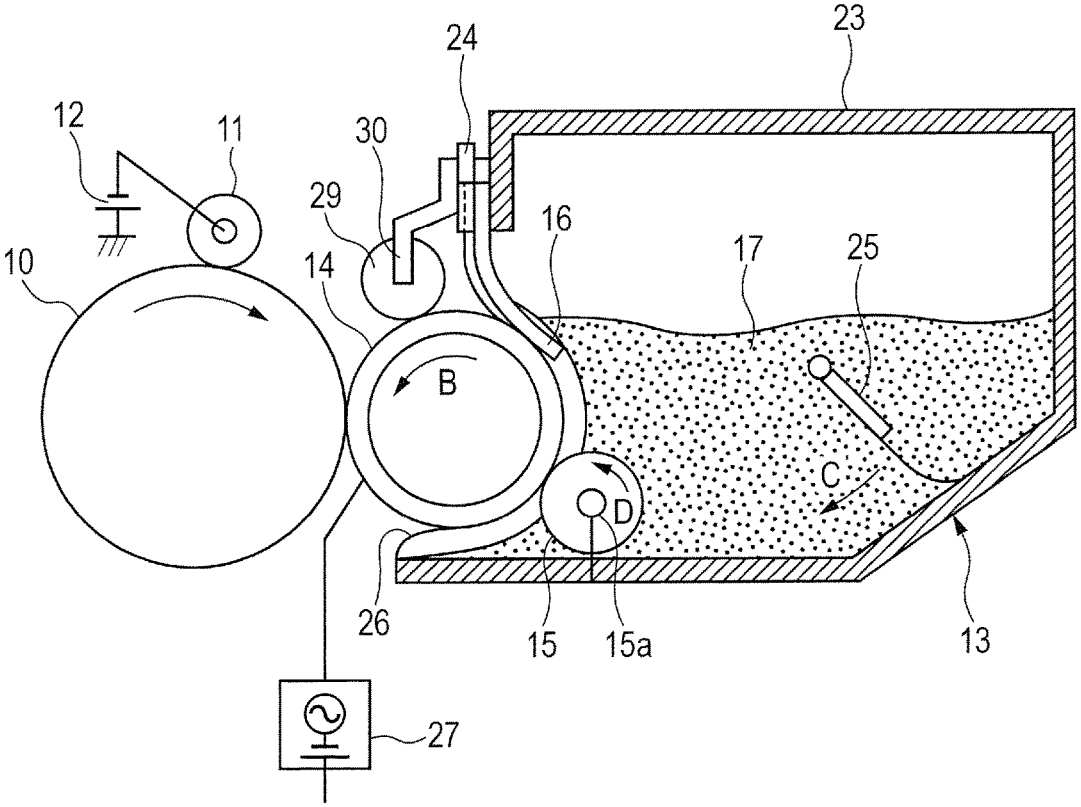
FIG. 1 is an enlarged view of a developing portion.

Preferred embodiments of the present invention will now be described in detail in accordance with the accompanying drawings.

The inventors of the present invention have made extensive investigations, and as a result, have found that the moisture absorbing property and flowability of a toner can be improved by fixing resin particles to toner base particles each containing specific amounts of both a polyester resin A having an isosorbide unit (hereinafter sometimes simply referred to as "polyester resin A") and a styrene-acrylic resin.

The toner particles of a toner of the present invention each contain the polyester resin A having an isosorbide unit and the styrene-acrylic resin as resins. In addition, the content of the styrene-acrylic resin is 50.0 mass % or more with reference to the mass of the resins contained in the toner. Setting the ratio of the styrene-acrylic resin to 50.0 mass % or more can optimize the charge quantity of the toner and can sharpen the charge quantity distribution of the toner. As a result, an image having a satisfactory image density and suppressed in fogging can be obtained by using the toner of the present invention.

The content of the styrene-acrylic resin in the present invention is calculated from the following equation. It should be noted that a method of determining the amount of the styrene-acrylic resin contained in the resins in the toner is described later.

Content (mass %) of styrene-acrylic resin=(amount (mass) of styrene-acrylic resin/amount (mass) of resins contained in toner)×100

The inventors of the present invention have considered that causing both the polyester resin A having a relatively low resistance and the styrene-acrylic resin having a relatively high resistance to exist in optimum amounts optimizes the resistance of the toner, and as a result, sharpens the charge quantity distribution of the toner. In addition, the inventors have considered that the existence optimizes the charge quantity of the toner as well because the existence can suppress the moisture absorbing property of the toner.

In the present invention, the flowability of the toner can be improved by using the toner particles obtained by fixing the resin particles to the toner base particles.

The inventors of the present invention have considered that the resin particles fixing to the surfaces of the toner base particles suppress the exposure of a release agent and the low-molecular weight components of the resins responsible for a reduction in flowability to the surfaces of the toner particles over a long time period, and hence can alleviate the aggregation of the toner particles. The inventors have considered that as a result of the foregoing, development efficiency and transfer efficiency become satisfactory, and hence the density unevenness of an image can be suppressed.

In the present invention, the fixing amount of the resin particles to the toner base particles is 0.1 part by mass or more and 5.0 parts by mass or less with respect to 100.0 parts by mass of the toner base particles.

The flowability of the toner is affected by how the surfaces of the toner base particles are covered with the resin particles. When the fixing amount of the resin particles falls within the range, the resin particles can effectively function in proper quantities.

When the fixing amount of the resin particles is less than 0.1 part by mass, the fixing amount is so small that their contribution to the flowability becomes poor. In particular, under high temperature and high humidity, a suppressing effect on the exudation of the release agent to the surfaces of the toner particles becomes poor, and hence the flowability of the toner tends to reduce.

When the fixing amount of the resin particles exceeds 5.0 parts by mass, the adhesiveness of part of the resin particles with the toner base particles reduces and hence the falling of the resin particles occurs. The fallen resin particles may cause the contamination of a member in a developing portion.

In addition, in the present invention, a glass transition temperature Tg2 (° C.) of the resin particles is higher than a glass transition temperature Tg1 (° C.) of the toner base particles. Thus, even when a load is continuously applied to the toner by the output of a large number of images, the embedding of the resin particles in the toner base particles is suppressed. That is, the density unevenness of an image can be stably suppressed over a long time period.

The styrene-acrylic resin of the present invention is a copolymer of a styrene-based monomer and an acrylic monomer. Any other monomer may be used in combination with the monomers.

Examples of the styrene-based monomer include: styrene; and styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene.

Examples of the acrylic monomer include: acrylic acid; acrylic acid esters such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, and diethylaminoethyl acrylate; methacrylic acid; and methacrylic acid esters such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, and diethylaminoethyl methacrylate.

In addition, in the present invention, a crosslinking agent that is bifunctional or is trifunctional or more may be used for the purposes of, for example, improving the mechanical strength of each toner particle and controlling the molecular weight of the styrene-acrylic resin.

Examples of the bifunctional crosslinking agent (crosslinking agent having two or more vinyl groups) include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, a polyester-type diacrylate (trade name: MANDA, manufactured by Nippon Kayaku Co., Ltd.), and ones obtained by changing these diacrylates to dimethacrylates.

Examples of the tri- or more functional crosslinking agents include pentaerythritol triacrylate, trimethylolethane triacrylate, trimethylolpropane triacrylate, tetramethylolmethane tetraacrylate, oligoester acrylate, and ones obtained by changing these acrylates to methacrylates, 2,2-bis(4-methacryloxypolyethoxyphenyl)propane, diallyl phthalate, triallyl cyanurate, triallyl isocyanurate, and triallyl trimellitate.

The styrene-acrylic resin preferably has a peak molecular weight (Mp) of 5,000 or more and 30,000 or less.

When the peak molecular weight (Mp) is 5,000 or more, the molecular motion of the molecular chain of the polyester resin A coexisting with the styrene-acrylic resin can be moderately suppressed, and hence the moisture absorbing property of the toner under a high-humidity environment can be satisfactorily suppressed. As a result, a reduction in charge quantity of the toner can be suppressed.

In addition, when the peak molecular weight (Mp) is 30,000 or less, a reduction in compatibility between the styrene-acrylic resin and the polyester resin A is suppressed, and hence a large domain of the polyester resin A hardly exists in each toner particle. As a result, the deterioration of the charge quantity distribution of the toner is suppressed.

The peak molecular weight of the resin is measured by employing gel permeation chromatography (GPC) under the following conditions.

A column is stabilized in a heat chamber at 40° C. and tetrahydrofuran (THF) is allowed to flow as a solvent through the column at 40° C. at a flow rate of 1 mL per minute. In order to perform accurate measurement in the molecular weight region of from $1\times10^3$ to $2\times10^6$, it is appropriate to combine, as the column, a plurality of commercially available polystyrene gel columns. Examples thereof include: a combination of shodex GPC KF-801, 802, 803, 804, 805, 806, 807, and 800P manufactured by Showa Denko K.K.; and a combination of TSKgel G1000H(HXL), G2000H(HXL), G3000H(HXL), G4000H(HXL), G5000H (HXL), G6000H(HXL), G7000H(HXL), and TSK guard column manufactured by Tosoh Corporation. A combination of 7 consecutive columns shodex KF-801, 802, 803, 804, 805, 806, and 807 manufactured by Showa Denko K.K. is particularly preferred, and the inventors of the present invention have adopted the combination.

Meanwhile, the resin is dissolved in THF and then the solution is left at rest overnight. After that, the solution is filtered with a sample treating filter (pore size: 0.2 to 0.5 μm, for example, a Maishori Disk H-25-2 (manufactured by Tosoh Corporation) can be used), and the filtrate is used as a sample. The measurement is performed by injecting 50 to 200 μL of the solution of the resin in THF whose sample concentration has been adjusted to from 0.5 to 5 mg/mL in terms of a resin component. A refractive index (RI) detector is used as a detector.

At the time of the measurement of the molecular weight of the sample, the molecular weight distribution of the sample is calculated from a relationship between the logarithmic value of a calibration curve created by using several kinds of monodisperse polystyrene standard samples and the number of counts. As the standard polystyrene samples for creating the calibration curve, ones manufactured by Pressure Chemical Co. or Tosho Corporation, and having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are preferably used. In addition, at least about 10 standard polystyrene samples are preferably used.

The polyester resin A to be used in the present invention refers to a polyester resin containing an isosorbide unit (unit represented by the formula (1)). In addition, the ratio of the isosorbide unit is 0.10 number % or more and 30.00 number % or less with reference to the number of all units constituting the polyester resin A.

Isosorbide has an extremely high moisture absorbing property because isosorbide is of a cyclic structure having an ether structure in a molecule thereof. The incorporation of the isosorbide unit into the polyester resin can set the resistance value of the polyester resin to a proper value. In the present invention, the chargeability of the toner is improved by utilizing the moisture absorbing property and resistance characteristic of isosorbide. When the ratio of the isosorbide unit in the polyester resin A falls within the range, its interaction with the styrene-acrylic resin effectively acts to improve the chargeability of the toner.

In the case where the ratio of the isosorbide unit is less than 0.10 number %, the ratio of presence of the isosorbide unit in the polymer chain of the polyester resin A is so small that its characteristic of contributing to the chargeability of the polyester resin A becomes poor. Specifically, the moisture absorbing property of the polyester resin A reduces, and hence under a low-humidity environment, the charge quantity of the toner increases and a reduction in image density is liable to occur.

In addition, in the case where the ratio of the isosorbide unit exceeds 30.00 number %, a block moiety of the isosorbide unit is liable to exist in the polymer chain of the polyester resin A and the moisture absorbing property of the block moiety strongly acts. As a result, the charge quantity of the toner under a high-humidity environment is liable to reduce. In this case as well, a reduction in image density is liable to occur.

For the synthesis of the polyester resin A, isosorbide is used as an alcohol component, and can be used in combination with the following alcohol components.

As a dihydric alcohol component, for example, there are given: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; aliphatic diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenol A and bisphenol A derivatives such as hydrogenated bisphenol A.

As a trihydric or higher alcohol component, for example, there are given sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

In addition, as an acid component that can be used for the synthesis of the polyester resin A, for example, there are given: aromatic polyvalent carboxylic acids such as phthalic acid, isophthalic acid, terephthalic acid, trimellitic acid, and pyromellitic acid; aliphatic polyvalent carboxylic acids such as fumaric acid, maleic acid, adipic acid, succinic acid, and succinic acid substituted with an alkyl group having 1 to 20 carbon atoms or an alkenyl group having 2 to 20 carbon atoms, such as dodecenyl succinic acid and octenyl succinic acid; and anhydrides and alkyl (having 1 to 8 carbon atoms) esters of those acids.

A polyester resin obtained by the condensation polymerization of the following components out of the foregoing components is particularly preferred: isosorbide and a bisphenol derivative are used as alcohol components, and a carboxylic acid that is divalent or more, or an acid anhydride or lower alkyl ester thereof is used as an acid component.

In the present invention, the content of the polyester resin A is 1.0 mass % or more and 40.0 mass % or less with reference to the mass of the resins contained in the toner.

The content of the polyester resin A in the present invention is calculated from the following equation. It should be noted that a method of determining the amount of the polyester resin A contained in the resins in the toner is described later.

Content (mass %) of polyester resin $A$=(amount (mass) of polyester resin $A$/amount (mass) of resins contained in toner)×100

When the content of the polyester resin A is less than 1.0 mass %, the interaction between the polyester resin A and the styrene-acrylic resin is not sufficient, and hence satisfactory chargeability of the toner is hardly obtained.

In addition, when the content of the polyester resin A exceeds 40.0 mass %, a reduction in moisture absorbing property of the toner is liable to occur.

In the present invention, any other styrene resin, acrylic resin, or polyester resin may be used in combination with the styrene-acrylic resin and the polyester resin A.

The polyester resin A has an acid value of 0.5 mgKOH/g or more and 25.0 mgKOH/g or less.

When the acid value is 0.5 mgKOH/g or more, the compatibility of the resin with the styrene-acrylic resin becomes particularly suitable, and hence a reduction in resistance value of the toner is suppressed. As a result, the charge quantity of the toner hardly reduces.

In addition, when the acid value is 25.0 mgKOH/g or less, the occurrence of a large domain of the polyester resin A in each toner particle is suppressed, and hence the charge quantity distribution of the toner can be additionally sharpened.

The acid value in the present invention is determined by the following operations. A basic operation was in accordance with JIS K0070 and the acid value of a polar resin was measured by the following method.

The acid value is the number of milligrams of potassium hydroxide required for neutralizing an acid contained in 1 g of a sample. The acid value of the polar resin was measured in accordance with JIS K 0070-1992, specifically, the following procedure.

(1) Preparation of Reagent 1.0 g of phenolphthalein was dissolved in 90 mL of ethyl alcohol (95 vol %), and ion-exchanged water was added to the resultant to provide 100 mL of a phenolphthalein solution.

7 g of (guaranteed) potassium hydroxide was dissolved in 5 mL of water, and ethyl alcohol (95 vol %) was added to the resultant to provide 1 L of a solution. The solution was put in a container having alkali resistance so as not to come into contact with a carbon dioxide gas and the like, and was left to stand for 3 days. After that, the solution was filtered to provide a potassium hydroxide solution. The potassium hydroxide solution thus obtained was stored in the container having alkali resistance. The factor of the potassium hydroxide solution was determined by putting 25 mL of 0.1 mol/L hydrochloric acid in an Erlenmeyer flask, adding drops of the phenolphthalein solution to the hydrochloric acid, titrating the resultant with the potassium hydroxide solution, and obtaining the amount of the potassium hydroxide solution used for neutralization. Hydrochloric acid prepared in accordance with JIS K 8001-1998 was used as the 0.1 mol/L hydrochloric acid.

(2) Operation (A) Main Test 2.0 g of a sample of a pulverized resin (binder resin or polar resin) was precisely weighed in a 200-mL Erlenmeyer flask, and 100 mL of a mixed solution of toluene and ethanol (2:1) was added to the sample to dissolve the sample over 5 hours. Then, drops of the phenolphthalein solution as an indicator were added to the resultant, and the mixture thus obtained was titrated with the potassium hydroxide solution. It should be noted that the titration was finished when the indicator continued to exhibit a pale red color for about 30 seconds.

(B) Blank Test

The same titration as that in the above-mentioned operation was performed except that the sample was not used (that is, only the mixed solution of toluene and ethanol (2:1) was used).

(3) The result thus obtained was substituted into the following equation to calculate the acid value:

$$A=[(C-B)\times f\times 5.61]/S$$

where A represents the acid value (mgKOH/g), B represents the addition amount (mL) of the potassium hydroxide solution in the blank test, C represents the addition amount (mL) of the potassium hydroxide solution in the main test, f represents the factor of the potassium hydroxide solution, and S represents the sample (g).

The glass transition temperature Tg2 (° C.) of the resin particles is preferably 60.0° C. or more and 105.0° C. or less. The glass transition temperature Tg1 (° C.) of the toner base particles, which needs to be lower than the glass transition temperature Tg2 (° C.) of the resin particles, is preferably 50.0° C. or more and 58.0° C. or less.

When the Tg2 (° C.) is 60.0° C. or more, the resin particles are hardly embedded in the toner base particles, and hence density unevenness under high temperature and high humidity is additionally suppressed.

When the Tg2 (° C.) is 105.0° C. or less, a reduction in adhesiveness of the resin particles with the toner base particles is suppressed, and hence the deterioration of the flowability of the toner due to the detachment of the resin particles is suppressed. As a result, the density unevenness is additionally suppressed.

In the present invention, the resin particles preferably have a median diameter (D50) on a volume basis (hereinafter sometimes simply referred to as "median diameter (D50)" or "median diameter") of 20 nm or more and 200 nm or less.

When the median diameter (D50) of the resin particles is 20 nm or more, the resin particles are hardly embedded in the toner base particles even by the output of a large number of images, and hence the deterioration of the flowability of the toner is suppressed.

When the median diameter (D50) of the resin particles is 200 nm or less, nonuniform fixing of the resin particles to the toner base particles is suppressed, and hence the resin particles hardly peel.

It should be noted that the median diameter is a particle diameter defined as the 50% value (median cumulative value) of a particle size distribution cumulative curve, and can be measured with, for example, a laser diffraction/scattering particle diameter distribution measuring apparatus manufactured by Horiba, Ltd. (trade name: LA-920). The median diameter (D50) of the resin particles can be controlled depending on the physical properties of a resin constituting the resin particles and a condition under which the resin particles are produced. With regard to the physical properties, the median diameter can be controlled depending on, for example, the acid value, kind of a functional group, and molecular weight of the resin constituting the resin particles.

As a colorant to be used for the toner particles, there are given, for example, a black colorant, a yellow colorant, a magenta colorant, and a cyan colorant.

Examples of the black colorant include carbon black and a magnetic material. A colorant toned with the following yellow, magenta, and cyan colorants can also be utilized as the black colorant. In particular, when the toner is produced by a suspension polymerization method, attention needs to be paid at the time of the use of dyes and carbon black because many of such materials have polymerization inhibiting properties.

Examples of the yellow colorant include a condensed azo compound, an isoindolinone compound, an anthraquinone compound, an azo metal complex, a methine compound, and an allyl amide compound. Specific examples thereof include C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of the magenta colorant include a condensed azo compound, a diketopyrrolopyrrole compound, anthraquinone, a quinacridone compound, a base dye lake compound, a naphthol compound, a benzimidazolone compound, a thioindigo compound, and a perylene compound. Specific examples thereof include C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, and 269, and C.I. Pigment Violet 19.

Examples of the cyan colorant include a copper phthalocyanine compound and derivatives thereof, an anthraquinone compound, and a base dye lake compound. Specific examples thereof include C.I. Pigment Blue 1, 7, 15, 15:1, 15:2, 15:3, 15:4, 60, 62, and 66.

One kind of those colorants may be used, or two or more kinds thereof may be used. When two or more kinds thereof are used, the colorants may be used as a mixture or may be used in the state of a solid solution.

The colorant is preferably selected from the viewpoints of a hue angle, chroma, lightness, light fastness, OHP transparency, and dispersibility in the toner.

The content of the colorant in each toner particle is preferably 1 part by mass or more and 20 parts by mass or less with respect to 100 parts by mass of the resins.

In addition, the toner of the present invention can be provided as a magnetic toner by incorporating a magnetic material. In this case, the magnetic material can also function as a colorant. Examples of the magnetic material include: iron oxides such as magnetite, hematite, and ferrite; metals such as iron, cobalt, and nickel; and alloys of these metals and metals such as aluminum, cobalt, copper, lead, magnesium, tin, zinc, antimony, beryllium, bismuth, cadmium, calcium, manganese, selenium, titanium, tungsten, and vanadium.

The magnetic material is preferably a surface-modified magnetic material. When the magnetic toner is produced by a suspension polymerization method, a magnetic material subjected to a hydrophobic treatment with a surface modifier as a substance that does not inhibit polymerization is preferred. Examples of such surface modifier include a silane coupling agent and a titanium coupling agent.

The number-average particle diameter of the magnetic material is preferably 2.0 μm or less, more preferably 0.1 μm or more and 0.5 μm or less.

The content of the magnetic material in each toner particle is preferably 20 parts by mass or more and 200 parts by mass or less, more preferably 40 parts by mass or more and 150 parts by mass or less with respect to 100 parts by mass of the resins or polymerizable monomers producing the resins.

The toner particles can each contain a wax (release agent).

Examples of the wax include petroleum-based waxes and derivatives thereof such as paraffin wax, microcrystalline wax, and petrolatum; montan wax and derivatives thereof; hydrocarbon waxes and derivatives thereof by a Fischer-Tropsch process; polyolefin waxes and derivatives thereof such as polyethylene wax and polypropylene wax; and natural waxes and derivatives thereof such as carnauba wax and candelilla wax. Examples of the derivatives include an oxide, a block copolymer with a vinyl-based monomer, and a graft modified product. Other examples of the wax include: higher aliphatic alcohols; fatty acids such as stearic acid and palmitic acid; acid amide waxes; ester waxes; hydrogenated castor oil and derivatives thereof; plant waxes; and animal waxes. Of those waxes, an ester wax and a hydrocarbon wax are preferred from the viewpoint that the waxes are excellent in releasability. Further, a high-purity wax containing 50 mass % or more and 95 mass % or less of compounds identical to each other in total number of carbon atoms is preferred from the viewpoint of developability.

The content of the wax in each toner particle is preferably 1 part by mass or more and 40 parts by mass or less, more preferably 3 parts by mass or more and 25 parts by mass or less with respect to 100 parts by mass of the resins or polymerizable monomers producing the resins.

When the content of the wax is 1 part by mass or more and 40 parts by mass or less, the wax can have a moderate bleeding property at the time of the heating and pressurization of the toner, and hence the winding resistance at high temperature improves. Further, even when the toner receives a stress at the time of development or transfer, the exposure of the wax to the surfaces of the toner particles is suppressed, and hence the toner particles can each obtain uniform chargeability.

It is preferred that inorganic fine particles be externally added to the toner particles for the purpose of improving the flowability.

The inorganic fine particles to be externally added to the toner particles preferably contain silica fine particles.

The number-average particle diameter of the primary particles of the inorganic fine particles is preferably 4 nm or more and 80 nm or less. When the number-average particle diameter of the primary particles of the inorganic fine particles falls within the range, the flowability of the toner improves and the storage stability of the toner also improves.

The number-average particle diameter of the primary particles of the inorganic fine particles is measured as described below.

The primary particles are observed with a scanning electron microscope, and the particle diameters of 100 inorganic fine particles in the field of view are measured. The number-average particle diameter is determined by averaging the measured values.

In addition, the silica fine particles and fine particles of titania, alumina, or a multiple oxide thereof can be used in combination as the inorganic fine particles. Titania fine particles are preferred as inorganic fine particles to be used in combination with the silica fine particles.

Examples of the silica fine particles include dry silica produced by the vapor phase oxidation of a silicon halide, dry silica called fumed silica, and wet silica produced from water glass. The silica fine particles are preferably dry silica that has a small number of silanol groups on its surface and inside itself, and produces small amounts of $Na_2O$ and $SO_3^{2-}$ as production residues. In addition, in a production process for the dry silica, composite fine particles of silica and any other metal oxide can be obtained by using any other metal halide such as aluminum chloride or titanium chloride with a silicon halide. In the present invention, the composite fine particles are also included in the silica fine particles.

The inorganic fine particles are added for uniformizing the triboelectric charging of the toner particles as well as for improving the flowability of the toner. Inorganic fine particles subjected to a hydrophobic treatment are preferably used because subjecting the inorganic fine particles to the hydrophobic treatment can impart functions such as the adjustment of the triboelectric charge quantity of the toner, an improvement in its environmental stability, and improvements in its characteristics under a high-humidity environment. When the inorganic fine particles externally added to the toner particles absorb moisture, the triboelectric charge quantity of the toner reduces, and hence reductions in its developability and transferability are liable to occur.

Examples of a treatment agent for the hydrophobic treatment of the inorganic fine particles include an unmodified silicone varnish, various modified silicone varnishes, an unmodified silicone oil, various modified silicone oils, a silane compound, and a silane coupling agent. Further, examples thereof include other organosilicon compounds and an organotitanium compound. One kind of those and other treatment agents may be used alone, or two or more kinds thereof may be used.

Inorganic fine particles treated with a silicone oil out of those treatment agents are preferred. More preferred are hydrophobic-treated inorganic fine particles obtained by treating inorganic fine particles with the silicone oil simultaneously with a hydrophobic treatment with a coupling agent or after the hydrophobic treatment with the coupling agent. The hydrophobic-treated inorganic fine particles are preferred from the viewpoint that even under a high-humidity environment, the triboelectric charge quantity of the toner particles can be maintained at a high level and their selective developability can be reduced.

The toner base particles can be produced by a production method such as a suspension polymerization method, a dissolution suspension method, an emulsion aggregation method, or a pulverizing method. Of the production methods, a suspension polymerization method is preferred because the states of existence of the styrene-acrylic resin and polyester resin A near the surfaces of the toner base particles can be easily controlled by utilizing balance between the polarity of water and that of a material for the toner base particles. The suspension polymerization method can improve the chargeability of the toner.

The toner base particles may be obtained by forming particles of a polymerizable monomer composition containing the polyester resin A, the colorant, and polymerizable monomers in an aqueous medium, and polymerizing the polymerizable monomers. Another method of producing the toner base particles is based on the suspension polymerization and is described below.

When the toner base particles are produced by the suspension polymerization method, particles of a polymerizable monomer composition containing the polyester resin A, the colorant, and polymerizable monomers are formed (granulated) in an aqueous medium, and the polymerizable monomers are polymerized. Then, particles obtained by polymerizing the polymerizable monomers are filtered, washed, and dried. Thus, the toner base particles can be obtained. The remaining polymerizable monomers may be removed as required by performing distillation after the polymerization. The styrene-based monomer and the acrylic monomer are used as the polymerizable monomers.

A polymerization initiator that can be used in the polymerization of the polymerizable monomers may be added simultaneously with the addition of any other additive to the polymerizable monomers, or may be added immediately before the formation of the particles of the polymerizable monomer composition in the aqueous medium. In addition, the polymerizable monomers or the polymerization initiator dissolved in a solvent may be added immediately after the formation of the particles of the polymerizable monomer composition and before the initiation of the polymerization reaction.

Examples of the polymerization initiator include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and tert-butyl-peroxypivalate. The kind of the polymerization initiator is selected with reference to a 10-hour half-life temperature.

One kind of those polymerization initiators may be used alone, or two or more kinds thereof may be used.

The usage of any such polymerization initiator is preferably 3.0 parts by mass or more and 20.0 parts by mass or less with respect to 100.0 parts by mass of the polymerizable monomers. The kind of the polymerization initiator is selected with reference to a 10-hour half-life temperature, though the kind to be selected varies to some extent depending on a polymerization method. One kind of the polymerization initiators is used alone, or two or more kinds thereof are used as a mixture.

As a dispersant for dispersing the polymerizable monomer composition in the aqueous medium, there are given an inorganic dispersion stabilizer and an organic dispersion stabilizer.

Examples of the inorganic dispersion stabilizer include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina.

Examples of the organic dispersion stabilizer include polyvinyl alcohol, gelatin, methylcellulose, methylhydroxypropylcellulose, ethylcellulose, carboxymethylcellulose sodium salt, and starch.

In addition, a nonionic, anionic, or cationic surfactant can also be utilized as the dispersion stabilizer.

Examples of the surfactant include sodium dodecyl sulfate, sodium tetradecyl sulfate, sodium pentadecyl sulfate, sodium octyl sulfate, sodium oleate, sodium laurate, potassium stearate, and calcium oleate.

Of those dispersion stabilizers, an inorganic and hardly water-soluble dispersion stabilizer is preferred. In addition, a hardly water-soluble inorganic dispersion stabilizer that is soluble in an acid is more preferred.

In addition, the usage of the dispersion stabilizer is preferably 0.2 part by mass or more and 2.0 parts by mass or less with respect to 100.0 parts by mass of the polymerizable monomers.

In addition, with regard to the usage of the aqueous medium, an aqueous medium prepared using water in an amount of 300 parts by mass or more and 3,000 parts by mass or less with respect to 100 parts by mass of the polymerizable monomer composition is preferred.

When an aqueous medium having dispersed therein a hardly water-soluble inorganic dispersion stabilizer is prepared, the dispersion stabilizer may be dispersed as it is in a liquid medium such as water. In addition, in order that particles of the dispersion stabilizer having a fine and uniform particle size may be obtained, the aqueous medium may be prepared by adding a raw material for the hardly water-soluble inorganic dispersion stabilizer to a liquid medium such as water under high-speed stirring and producing the hardly water-soluble inorganic dispersion stabilizer. For example, when tricalcium phosphate as one kind of the hardly water-soluble inorganic dispersion stabilizer is used as a dispersion stabilizer, fine particles of tricalcium phosphate can be formed by mixing an aqueous solution of sodium phosphate and an aqueous solution of calcium chloride under high-speed stirring.

A method of fixing the resin particles to the surfaces of the toner base particles of the present invention is, for example, a method involving subjecting the toner base particles and the resin particles to dry mixing, and mechanically treating the mixture to fix the resin particles to the surfaces. Also available is, for example, a method involving dispersing the toner base particles and the resin particles in an aqueous medium, and heating the resultant or adding an aggregating agent to the resultant. The resin particles are preferably fixed to the surfaces of the toner base particles by heating in the aqueous medium in order that the resin particles may be uniformly fixed to the surfaces of the toner base particles and a variation between the toner base particles may be suppressed.

A particularly preferred example of the method of fixing the resin particles is described below.

First, the toner base particles are produced by a suspension polymerization method. At this time, an inorganic dispersant largely different from the toner base particles in polarity such as tricalcium phosphate is used as a dispersion stabilizer. In addition, even after the completion of polymerization, the removal of the dispersion stabilizer adhering to the surfaces of the toner base particles is not performed and stirring is continued as it is.

Next, an aqueous dispersion of the resin particles having an acid value is added to a dispersion liquid of the toner base particles in a state where the dispersion stabilizer adheres to the toner base particles. Thus, the resin particles electrostatically adhere to the surfaces of the toner base particles in a state where the dispersion stabilizer is interposed therebetween. Next, the resin particles are stuck (fixed) to the surfaces of the toner base particles by heating the dispersion liquid to a temperature equal to or more than the glass transition temperature of the resin particles.

At this time, the dispersion stabilizer may be separately added for suppressing aggregation between the toner base particles to additionally improve production stability. In addition, a small amount of a surfactant can be added.

After the resin particles have been fixed to the surfaces of the toner base particles, the dispersion stabilizer is removed at a temperature lower than the glass transition temperature of the toner base particles. After the dispersion stabilizer has been removed, the remainder is filtered, washed, and dried. Thus, the toner particles are obtained.

A method of producing the resin particles to be used in the toner particles of the present invention is, for example, an emulsion polymerization method, a soap-free emulsion polymerization method, or a phase inversion emulsion method. Of those production methods, a phase inversion emulsion method is preferred because resin particles having small particle diameters and a narrow particle size distribution are easily obtained.

A method of producing a resin particle dispersion liquid based on the phase inversion emulsion method is specifically described. A resin produced in advance is dissolved in an organic solvent in which the resin can dissolve, a surfactant, a neutralizer, or the like is added to the solution as required, and the solution is mixed with an aqueous medium while the solution is stirred. Thus, the solution of the resin undergoes phase inversion emulsion to form fine particles. The organic solvent can be removed by employing a method such as heating or decompression after the phase inversion emulsion.

An aqueous dispersion of stable resin particles having small particle diameters and a narrow particle size distribution can be obtained as described above.

Examples of a material for the resin particles include resins such as a vinyl-based resin, a polyester resin, an epoxy resin, and a urethane resin.

One kind of those resins may be used, or two or more kinds thereof may be used. In addition, a product obtained by crystallizing or hybridizing any such resin can be used. Further, part of any such resin may be modified and a resin provided with a function such as charging can also be used.

In addition, a hydrophilic functional group is preferably incorporated into the resin constituting the resin particles from the viewpoints of the dispersion stability of the resin particles in water and the chargeability of the toner. The hydrophilic functional group is preferably a carboxy group (carboxylic acid group) or a sulfo group (sulfonic acid group) from the viewpoint of the production stability of the toner particles. The acid value of the resin at this time is preferably 5.0 mgKOH/g or more and 50.0 mgKOH/g or less from the viewpoints of the dispersion stability of the resin particles and the charging stability of the toner. When the acid value is 5.0 mgKOH/g or more, the dispersion stability of the resin particles in water hardly reduces and hence the particles hardly aggregate. In addition, the adhesive force of the resin particles to the dispersion stabilizer hardly becomes insufficient, and hence the particles uniformly fix to the surfaces of the toner base particles with ease. In addition, when the acid value is 50.0 mgKOH/g or less, a change in charge quantity of the toner under a high-humidity environment hardly occurs.

Hereinafter, methods of measuring respective physical properties in the present invention are described.

(Method of Calculating Contents of Styrene-Acrylic Resin and Polyester Resin A with Respect to Resins in Toner, and Method of Calculating Content of Isosorbide Unit in Polyester Resin A)

Pyrolysis gas chromatography mass spectrometry (hereinafter referred to as "pyrolysis GC/MS") and NMR are employed in the analysis of the contents of the resins and the content of the isosorbide unit. It should be noted that in the present invention, a component having a molecular weight of 1,500 or more is regarded as a measuring object. This is because a region corresponding to a molecular weight of less than 1,500 is considered to be a region in which the ratio of a wax is high and hence substantially no resins are contained.

In the pyrolysis GC/MS, the peak area of each monomer can be quantified by determining constituent monomers for the total amount of the resins in the toner. However, the normalization of a peak intensity with a sample having a known concentration serving as a reference is needed for performing the quantification. On the other hand, in the NMR, the determination and quantification of the constituent monomers can be performed without the use of the sample having a known concentration. In view of the foregoing, depending on the situation, the determination of the constituent monomers is performed while the spectra of both the NMR and the pyrolysis GC/MS are compared.

Specifically, in the case where the content of a resin component that does not dissolve in deuterated chloroform as an extraction solvent at the time of NMR measurement is less than 5.0 mass %, quantification by the NMR measurement is performed.

On the other hand, in the case where the resin component that does not dissolve in deuterated chloroform as an extraction solvent at the time of the NMR measurement is present at a content of 5.0 mass % or more, both the NMR measurement and pyrolysis GC/MS measurement are performed for deuterated chloroform-soluble matter, and the pyrolysis GC/MS measurement is performed for the deuterated chloroform-insoluble matter. In this case, the NMR measurement of the deuterated chloroform-soluble matter is performed first, and the determination and quantification of the constituent monomers are performed (Quantification Result 1). Next, the pyrolysis GC/MS measurement is performed for the deuterated chloroform-soluble matter, and the peak area of a peak assigned to each constituent monomer is determined. A relationship between the amount of each constituent monomer and the peak area of the pyrolysis GC/MS is determined by using Quantification Result 1 obtained in the NMR measurement. Next, the pyrolysis GC/MS measurement of the deuterated chloroform-insoluble matter is performed, and the peak area of a peak assigned to each constituent monomer is determined. A constituent monomer in the deuterated chloroform-insoluble matter is quantified from the relationship between the amount of each constituent monomer and the peak area of the pyrolysis GC/MS obtained in the measurement of the deuterated chloroform-soluble matter (Quantification Result 2). Then, Quantification Result 1 and Quantification Result 2 are combined to provide the final quantification results of the respective constituent monomers.

Specifically, the following operations are performed.

(1) 500 Milligrams of the toner is precisely weighed in a 30-mL sample bottle made of glass and 10 mL of deuterated chloroform is added to the bottle. After that, the bottle is lidded and the toner is dissolved by dispersing the mixture with an ultrasonic disperser for 1 hour. Next, the solution is filtered with a membrane filter having a diameter of 0.4 μm and the filtrate is recovered. At this time, the deuterated chloroform-insoluble matter remains on the membrane filter.

(2) 3 Milliliters of the filtrate is fractionated, a component having a molecular weight of less than 1,500 is removed by using high-performance liquid chromatography (HPLC) and a fraction collector, and a resin solution from which the component having a molecular weight of less than 1,500 has been removed is recovered. Chloroform is removed from the recovered solution with a rotary evaporator. Thus, a resin is obtained. It should be noted that the component having a molecular weight of less than 1,500 is determined by performing the measurement of a polystyrene resin having a known molecular weight in advance to determine its elution time.

(3) 20 Milligrams of the resultant resin is dissolved in 1 mL of deuterated chloroform and $^{1}$H-NMR measurement is performed. Spectra are assigned to the respective constituent monomers to be used in the styrene-acrylic resin and the polyester resin, and their quantitative values are determined.

(4) When the analysis of the deuterated chloroform-insoluble matter is needed, the analysis is performed by pyrolysis GC/MS. A derivatization treatment such as methylation is performed as required.

<Measurement Conditions for NMR>

Bruker AVANCE 500, manufactured by Bruker BioSpin
Measured nucleus: 1H
Measurement frequency: 500.1 MHz
Number of scans: 16 scans
Measurement temperature: room temperature <Measurement Conditions for Pyrolysis GC/MS>

Pyrolysis apparatus: TPS-700 manufactured by Japan Analytical Industry Co., Ltd.
Pyrolysis temperature: An appropriate value between 400° C. and 600° C., in this case, 590° C.
GC/MS apparatus: ISQ manufactured by Thermo Fisher Scientific Inc.
Column: "HP5-MS" (Agilent Technologies/190915-433), length: 30 m, inner diameter: 0.25 mm, film thickness: 0.25 μm
GC/MS conditions
Inlet condition:
Inlet Temp: 250° C.,
Split Flow: 50 mL/min
Condition for increasing temperature in GC: 40° C. (5 min)→10° C./min (300° C.)→300° C. (20 min)
Mass range: m/z=10 to 550

(D50 on Volume Basis of Resin Particles)

The median diameter (D50) on a volume basis of the resin particles was measured with a laser diffraction/scattering particle diameter distribution measuring apparatus. Specifically, the measurement was performed in conformity with JIS Z8825-1 (2001). A laser diffraction/scattering particle size distribution measuring apparatus (trade name: LA-920, manufactured by Horiba, Ltd.) was used as the measuring apparatus. Dedicated software included with the LA-920 (trade name: HORIBALA-920 for Windows (trademark) WET (LA-920) Ver. 2.02) was used in the setting of measurement conditions and the analysis of measurement data. In addition, ion-exchanged water from which impure solid matter and the like had been removed in advance was used as a measurement solvent. A measurement procedure is as described below.

(1) A batch-type cell holder is attached to the LA-920.

(2) A predetermined amount of the ion-exchanged water is charged into a batch-type cell, and the batch-type cell is set in the batch-type cell holder.

(3) The inside of the batch-type cell is stirred with a dedicated stirrer chip.

(4) A relative refractive index is set to a value corresponding to the resin particles by pressing the "refractive index" button of a "display condition setting" screen.

(5) A particle diameter basis is set to a volume basis in the "display condition setting" screen.

(6) After a warming-up has been performed for 1 hour or more, the adjustment of an optical axis, the fine adjustment of the optical axis, and blank measurement are performed.

(7) 3 Milliliters of the resin particle dispersion liquid is charged into a 100.0-mL flat-bottom beaker made of glass. The resin particle dispersion liquid is diluted by further adding 57 mL of ion-exchanged water. 0.3 Milliliter of a diluted solution prepared by diluting a "Contaminon N" (a 10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water three fold by mass is added as a dispersant to the diluted dispersion liquid.

(8) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. 3.3 Liters of ion-exchanged water is charged into the water tank of the ultrasonic dispersing unit. 2.0 Milliliters of the Contaminon N is charged into the water tank.

(9) The beaker in the section (7) is set in the beaker fixing hole of the ultrasonic dispersing unit, and the ultrasonic dispersing unit is operated. Then, the height position of the beaker is adjusted in order that the liquid level of the aqueous solution in the beaker may resonate with an ultrasonic wave from the ultrasonic dispersing unit to the fullest extent possible.

(10) The ultrasonic dispersion treatment is continued for 60 seconds. In addition, the temperature of water in the water tank is appropriately adjusted so as to be 10° C. or more and 40° C. or less upon ultrasonic dispersion.

(11) A transmittance for a tungsten lamp is adjusted to from 90% to 95% by immediately adding the resin particle dispersion liquid prepared in the section (10) to the batch-type cell little by little while paying attention so that air bubbles may not enter the dispersion liquid. Then, a particle size distribution is measured. The D50 is calculated based on the data of the resultant particle size distribution on a volume basis.

(Method of Measuring Glass Transition Temperatures (Tg) of Toner Base Particles and Resin Particles)

The glass transition temperatures (Tg) of the toner base particles and the resin particles are measured with a differential scanning calorimeter (DSC) M-DSC (trade name: Q2000, manufactured by TA Instruments) by the following procedure. 3 Milligrams of a sample to be subjected to the measurement (the toner base particles or the resin constituting the resin particles) is precisely weighed. The sample is loaded into an aluminum pan, and is subjected to the measurement under normal temperature and normal humidity by using an empty aluminum pan as a reference at a measurement temperature in the range of from 20 to 200° C. and a rate of temperature increase of 1° C./min. At this time, the measurement is performed at a modulation amplitude of ±0.5° C. and a frequency of 1/min. The glass transition temperature (Tg) (° C.) is calculated from a reversing heat flow curve to be obtained. A center value between the points of intersection of baselines before and after heat absorption, and a tangent to a curve based on the heat absorption is determined as the Tg (° C.).

Next, an image forming method in which the toner of the present invention can be used is described with reference to FIGS. 1 and 2.

Figure 2:
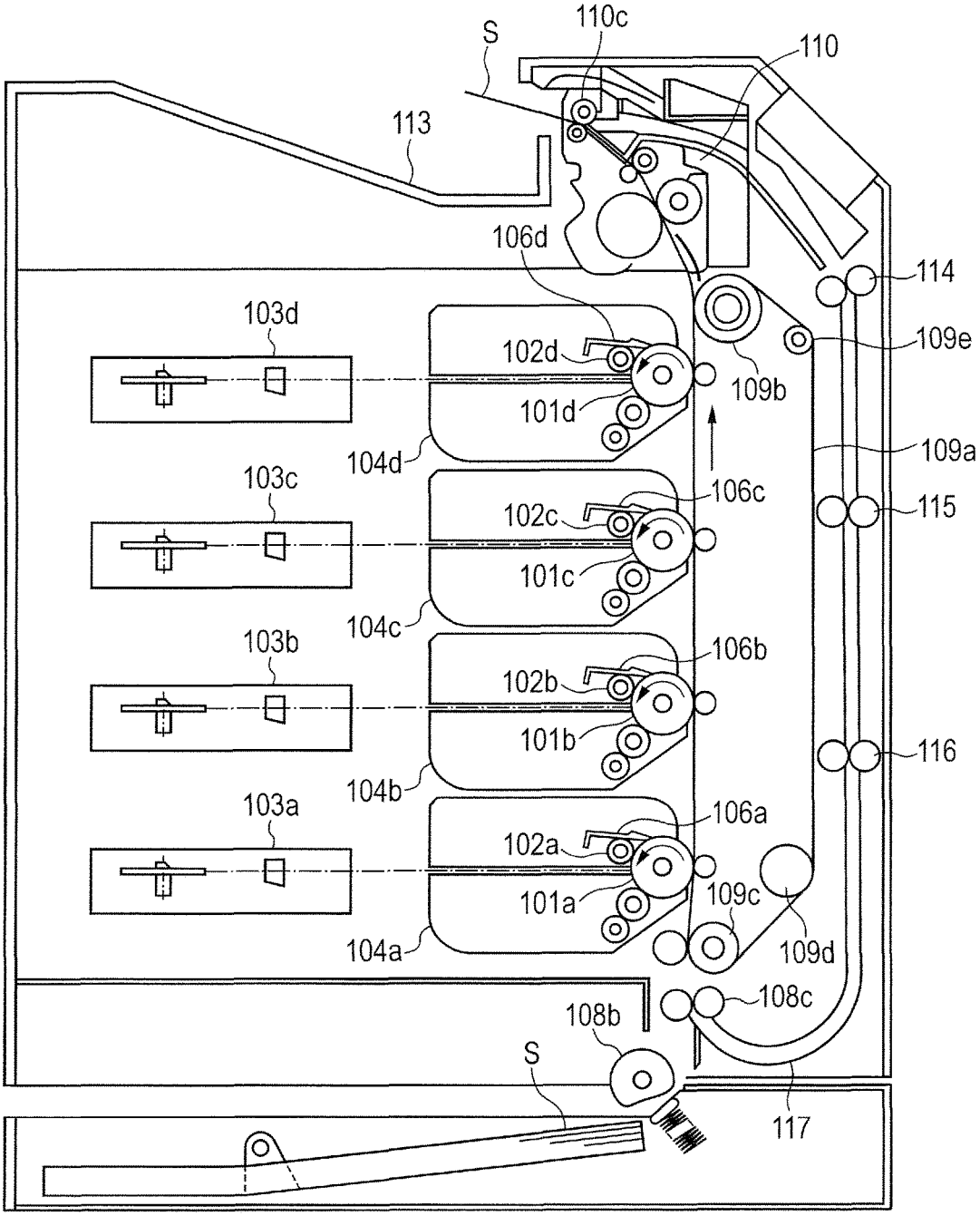
FIG. 2 is a sectional view of an image forming apparatus.

FIG. 2 illustrates the construction of an image forming apparatus that can perform an image forming method to be employed in Examples.

The image forming apparatus illustrated in FIG. 2 is a laser beam printer using an electrophotographic process. FIG. 2 illustrates a sectional view of a tandem-type color laser beam printer (LBP).

In FIG. 2, drum-type electrophotographic photosensitive members (hereinafter sometimes referred to as "photosensitive drums") 101 (101*a* to 101*d*) each rotate in a direction indicated by an arrow illustrated in the figure (counterclockwise direction) at a predetermined process speed. The photosensitive drums 101*a*, 101*b*, 101*c*, and 101*d* share the formation of the yellow (Y) component, magenta (M) component, cyan (C) component, and black (Bk) component of a color image, respectively.

Hereinafter, respective image forming apparatus for the Y, M, C, and Bk colors are represented as a unit a, a unit b, a unit c, and a unit d, respectively.

Those photosensitive drums 101*a* to 101*d* are rotationally driven by a drum motor (DC servo motor) (not shown). However, the respective photosensitive drums 101*a* to 101*d* may each be provided with an independent driving source. It should be noted that the rotational driving of the drum motor is controlled by a digital signal processor (DSP) (not shown) and any other control is performed by a CPU (not shown).

In addition, an electrostatic adsorption conveying belt 109*a* is stretched over a driving roller 109*b*, fixing rollers 109*c* and 109*e*, and a tension roller 109*d*, is rotationally driven by the driving roller 109*b* in a direction indicated by an arrow illustrated in the figure, and adsorbs and conveys a recording medium S (such as paper).

Hereinafter, description is given by taking the unit a (yellow) out of the units for the four colors as an example.

In its rotation process, the photosensitive drum 101*a* is uniformly subjected to a charging treatment to have predetermined polarity and a predetermined potential by a charging device (primary charging device) 102*a*. Then, the photosensitive drum 101*a* is irradiated with image exposure light from a laser beam exposure device 103*a*. Thus, an electrostatic latent image corresponding to image information is formed on the surface of the photosensitive drum 101*a*.

Next, the electrostatic latent image is developed with the toner of a developing portion 104*a*, whereby a toner image is formed on the surface of the photosensitive drum 101*a*. The same step is performed for each of the other three colors (magenta (M), cyan (C), and black (Bk)).

Four color toner images are sequentially transferred onto the recording medium S in nip portions between the photosensitive drums 101*a* to 101*d* and the electrostatic adsorption conveying belt 109*a*. A sheet feeding roller 108*b* conveys the recording medium S at a predetermined timing. In addition, a registration roller 108*c* stops and reconveys the recording medium S.

Remaining deposits such as transfer residual toner are removed from the photosensitive drums 101*a* to 101*d* after the transfer of the toner images onto the recording medium S by cleaning devices 106*a*, 106*b*, 106*c*, and 106*d*, and the drums are repeatedly subjected to image formation.

The recording medium S onto which the toner images have been transferred from the four photosensitive drums 101*a* to 101*d* is separated from the surface of the electrostatic adsorption conveying belt 109*a* by the driving roller 109*b*, and is fed into a fixing unit 110. In the fixing unit 110, the toner images are fixed. After that, the recording medium is discharged to a discharge tray 113 by a discharge roller 110*c*. It should be noted that reference symbols 114, 115 and 116 represent discharge rollers, and reference symbol 117 represents a sheet passing guide.

Next, an example of an image forming method of a nonmagnetic one-component contact development system is described with reference to an enlarged view of a developing portion illustrated in FIG. 1.

In FIG. 1, a developing unit 13 includes: a developer container 23 storing a nonmagnetic toner 17 as a one-component developer; and a toner carrier 14 positioned in an opening portion extending in a longitudinal direction in the developer container 23 and placed so as to be opposite to a photosensitive drum 10. In addition, the unit is configured to develop an electrostatic latent image on the surface of the photosensitive drum 10 with the nonmagnetic toner 17. A contact charging member 11 for a photosensitive drum abuts with the photosensitive drum 10. The bias of the contact charging member 11 is applied by a power source 12. It should be noted that reference symbol 25 represents a toner stirring member and reference symbol 26 represents a toner blowout preventing sheet.

The toner carrier 14 is laterally provided so that its right substantially half peripheral surface illustrated in FIG. 1 may enter the developer container 23 in the opening portion, and its left substantially half peripheral surface may be exposed to the outside of the developer container 23. As illustrated in FIG. 1, the surface exposed to the outside of the developer container 23 abuts with the photosensitive drum 10 positioned on the left side of the developing unit 13 in FIG. 1.

The toner carrier 14 is rotationally driven in a direction indicated by an arrow B. The peripheral speed of the photosensitive drum 10 is from 50 to 170 mm/sec, and the toner carrier 14 is rotated at a peripheral speed that is from one to two times as high as the peripheral speed of the photosensitive drum 10.

A regulating member 16 is supported by a regulating member supporting sheet metal 24 at a position above the toner carrier 14. The regulating member 16 has, for example, a metal plate made of stainless steel (SUS) or the like, a plate made of a rubber material such as a urethane rubber or a silicone rubber, or a metal thin plate made of SUS having spring elasticity, phosphor bronze, or the like as a substrate. In addition, the member has a rubber material bonded to a side closer to the abutting surface of the substrate with the toner carrier 14. The vicinity of a tip on the free end side of the regulating member 16 is provided so as to abut with the outer peripheral surface of the toner carrier 14 in a surface contact manner. The direction in which the vicinity abuts with the outer peripheral surface is the following so-called counter direction: a side closer to the tip with respect to an abutting portion is positioned on the upstream side of the rotation direction of the toner carrier 14. One example of the regulating member 16 is a construction in which a plate-like urethane rubber having a thickness of 1.0 mm is bonded to the regulating member supporting sheet metal 24, the construction having an appropriately set abutting pressure (linear pressure) with respect to the toner carrier 14. The abutting pressure is preferably 20 N/m or more and 300 N/m or less. The abutting pressure is measured by: inserting three metal thin plates having known coefficients of friction into the abutting portion; pulling out the central one with a spring balance; and converting the resultant value into the pressure. The regulating member 16 is preferably such that the rubber material and the like are bonded to the side closer to the abutting surface in terms of its adhesive property with the toner because the fusion of the toner to the regulating member in long-term use can be suppressed. In addition, the state of the abutment of the regulating member 16 with the toner carrier 14 can be edge abutment in which the tip is brought into abutment therewith. When the edge abutment is adopted, the abutting angle of the regulating member with respect to the tangent of the toner carrier at the contact point with the toner carrier is preferably set to 40° or less in terms of the regulation of a toner layer.

A toner supplying roller 15 is brought into abutment with the upstream side of the rotation direction of the toner carrier 14 with respect to the abutting portion of the regulating member 16 with the surface of the toner carrier 14, and is rotatably supported. The abutting width of the toner supplying roller 15 with respect to the toner carrier 14 is preferably 1 mm or more and 8 mm or less. In addition, the abutting portion is preferably provided with a relative velocity with respect to the toner carrier 14. It should be noted that reference symbol 15*a* represents a toner supplying roller axis.

A charging roller 29 is preferably placed. The charging roller 29 is an elastic body such as a NBR or a silicone rubber, and is attached to a suppressing member 30. The load under which the charging roller 29 is brought into abutment with the toner carrier 14 by the suppressing member 30 is preferably set to 0.49 N or more and 4.9 N or less. The abutment of the charging roller 29 brings the toner layer on the toner carrier 14 into a close-packed state and uniformly coats the carrier with the layer. With regard to a longitudinal positional relationship between the regulating member 16 and the charging roller 29, the charging roller 29 is preferably placed so as to be capable of covering the entire abutting region of the regulating member 16 on the toner carrier 14.

In addition, with regard to the driving of the charging roller 29, it is suitable that the roller follow the rotation of the toner carrier 14 or rotate at the same peripheral speed as that of the carrier. When there is no difference in peripheral speed between the charging roller and the toner carrier 14, the toner coating easily becomes uniform and unevenness hardly occurs on an image.

A bias to be applied to the charging roller 29 is applied as a DC voltage (a power source 27 of FIG. 1) by the power source 27 between both the toner carrier 14 and the photosensitive drum 10, and the nonmagnetic toner 17 on the toner carrier 14 is provided with charge from the charging roller 29 by discharge.

The bias of the charging roller 29 is preferably a bias equal to or more than a discharge start voltage identical to the nonmagnetic toner in polarity, and is preferably set so that a potential difference of 1,000 V or more and 2,000 V or less may occur between the roller and the toner carrier 14.

After having been provided with the charge from the charging roller 29, the toner layer formed on the toner carrier 14 is conveyed to a developing portion as a portion opposite to the photosensitive drum 10.

In the developing portion, the toner layer formed on the toner carrier 14 develops the electrostatic latent image on the surface of the photosensitive drum 10 with the DC bias applied by the power source 27 illustrated in FIG. 1 between both the toner carrier 14 and the photosensitive drum 10, thereby forming a toner image.

EXAMPLES

The present invention is hereinafter described specifically by way of Examples. However, the present invention is not limited to the following Examples.

Synthesis Example 1

Dispersion Liquid of Resin Particles A (Step 1: Synthesis of Resin a)

The following monomers were loaded into a reaction vessel provided with a stirrer, a condenser, a thermometer, and a nitrogen introducing tube, 0.03 part by mass of tetrabutoxy titanate was added as an esterification catalyst, and the mixture was allowed to warm to 220° C. and to react for 5 hours with stirring under a nitrogen atmosphere.

| | |
|---|---|
| Bisphenol A-propylene oxide (2 mol) adduct | 55.0 parts by mass |
| Ethylene glycol | 7.0 parts by mass |
| Terephthalic acid | 21.0 parts by mass |
| Isophthalic acid | 18.0 parts by mass |
| Trimellitic anhydride | 4.5 parts by mass |

Next, while a pressure in the reaction vessel was reduced to from 5 to 20 mmHg, the reaction was further performed for 5 hours. Thus, a resin a was obtained. Part of the resin a was extracted, and its glass transition temperature Tg2 and acid value were measured. Table 1 shows the physical properties.

(Step 2: Production of Dispersion Liquid of Resin Particles A)

100.0 Parts by mass of the resultant resin a, 45.0 parts by mass of methyl ethyl ketone, 45.0 parts by mass of tetrahydrofuran, 2.0 parts by mass of dimethylaminoethanol (DMAE), and 0.5 part by mass of sodium dodecylbenzenesulfonate (DBS) were loaded into a reaction vessel provided with a stirrer, a condenser, a thermometer, and a nitrogen introducing tube, and were dissolved by being heated to 80° C.

Next, under stirring, 300.0 parts by mass of ion-exchanged water at 80° C. was added to the solution to perform water dispersion. After that, the resultant water dispersion was transferred to a distilling apparatus and distilled until a fraction temperature reached 100° C.

After the resultant water dispersion had been cooled, ion-exchanged water was added to the water dispersion to adjust a resin concentration in a dispersion liquid to 20 mass %. The resultant dispersion liquid was defined as a dispersion liquid of resin particles A. Table shows the physical properties of the resultant resin particles A.

Synthesis Examples 2 to 7

Dispersion Liquids of Resin Particles B to G

Dispersion liquids of resin particles B to G were produced in the same manner as in the production of the dispersion liquid of the resin particles A except that the kinds and usages of the raw materials were changed as shown in Table 1. Table 1 shows the physical properties of the resultant resin particles B to G.

Synthesis Example 8

Dispersion Liquid of Resin Particles H (Step 1: Synthesis of Resin h)

100.0 Parts by mass of methyl ethyl ketone was loaded into a reaction vessel provided with a stirrer, a condenser, a thermometer, and a nitrogen introducing tube, and its temperature was increased to 80° C. under a nitrogen atmosphere. Next, 3.0 parts by mass of t-butyl peroxy-2-ethylhexanoate was added as a polymerization initiator to a mixture formed of the following monomers, and the whole was dropped to the reaction vessel over 2 hours with stirring.

| | |
|---|---|
| Styrene | 96.0 parts by mass |
| Methyl methacrylate | 2.2 parts by mass |
| Methacrylic acid | 1.8 parts by mass |

Next, a polymerization reaction was performed for hours while the temperature was held. After the reaction solution had been cooled, reprecipitation purification was performed by dropping the reaction solution in hexane. The resultant was filtered and dried to provide a resin h. Part of the resin h was extracted, and its glass transition temperature Tg2 and acid value were measured. Table 1 shows the physical properties.

(Step 2: Production of Dispersion Liquid of Resin Particles H)

150.0 Parts by mass of methyl ethyl ketone was loaded into a reaction vessel provided with a stirrer, a condenser, a thermometer, and a nitrogen introducing tube, and 100.0 parts by mass of the resin h was added to and dissolved in methyl ethyl ketone.

Next, 40.0 parts by mass of a 1 mol/L aqueous solution of sodium hydroxide was added to the solution and the mixture was stirred for 30 minutes. After that, 500.0 parts by mass of ion-exchanged water was added to the mixture to perform water dispersion.

The solvent was removed by distilling the resultant water dispersion under reduced pressure, and ion-exchanged water was added to the residue to adjust a resin concentration in a dispersion liquid to 20 mass %. The resultant dispersion liquid was defined as a dispersion liquid of resin particles H. Table 1 shows the physical properties of the resultant resin particles H.

Synthesis Example 9

Dispersion Liquid of Resin Particles I (Step 1: Synthesis of Resin i)

200.0 Parts by mass of xylene was loaded into a reaction vessel provided with a stirrer, a condenser, a thermometer, and a nitrogen introducing tube, and was refluxed in a stream of nitrogen.

Next, 6.0 parts by mass of 2-acrylamido-2-methylpropanesulfonic acid, 72.0 parts by mass of styrene, and 18.0 parts by mass of 2-ethylhexyl acrylate were mixed, and the mixture was dropped to the reaction vessel with stirring, and the liquid was left for 10 hours. After that, the solvent was removed by performing distillation, and the residue was dried under reduced pressure at 40° C. to provide a resin i. Part of the resin i was extracted, and its glass transition temperature Tg2 and acid value were measured. Table 1 shows the physical properties.

(Step 2: Production of Dispersion Liquid of Resin Particles I)

100.0 Parts by mass of THF was loaded into a 1-L tall beaker, and 60.0 parts by mass of the resin i was gradually added to and dissolved in THF with stirring. 1.5 Parts by mass of dimethylaminoethanol was added to and mixed in the solution. While stirring was continued, 180.0 parts by mass of ion-exchanged water was dropped to the mixture over 30 minutes to perform water dispersion. THF was removed from the resultant water dispersion by evaporation with an evaporator, and ion-exchanged water was added to the residue to adjust a resin concentration in a dispersion liquid to 20 mass %. The resultant dispersion liquid was defined as a dispersion liquid of resin particles I. Table shows the physical properties of the resultant resin particles I.

TABLE 1

| Synthesis Example | Resin particles | Acid component (part(s) by mass) TPA | IPA | TMA | Fumaric acid | Sodium 5-sulfoiso-phthalate | Alcohol component (part(s) by mass) BPA-PO | BPA-EO | EG | *Others (part(s) by mass) DMAE | DBS | Physical property Tg2 (° C.) | Median diameter (nm) | Acid value (mgKOH/g) |
|---|---|---|---|---|---|---|---|---|---|---|---|---|---|---|
| 1 | A | 21.0 | 18.0 | 4.5 | 0.0 | 0.0 | 55.0 | 0.0 | 7.0 | 2.0 | 0.5 | 68.8 | 52 | 12.9 |
| 2 | B | 26.0 | 5.0 | 4.8 | 8.5 | 0.0 | 53.0 | 0.0 | 10.0 | 2.0 | 0.5 | 55.3 | 65 | 13.3 |
| 3 | C | 21.5 | 16.0 | 1.8 | 0.0 | 0.0 | 55.0 | 0.0 | 6.0 | 1.5 | 0.5 | 69.5 | 160 | 5.5 |
| 4 | D | 15.0 | 7.0 | 17.3 | 0.0 | 0.0 | 57.0 | 0.0 | 7.0 | 8.0 | 0.5 | 67.2 | 30 | 48.5 |
| 5 | E | 21.0 | 13.0 | 0.0 | 0.0 | 9.8 | 52.0 | 0.0 | 8.0 | 5.0 | 0 0 | 71.2 | 15 | 20.5 |
| 6 | F | 25.0 | 16.0 | 2.4 | 0.0 | 0.0 | 49.0 | 0.0 | 9.5 | 1.0 | 0.5 | 68.1 | 190 | 7.0 |
| 7 | G | 26.0 | 9.0 | 0.0 | 0.0 | 5.9 | 50.0 | 0.0 | 9.5 | 2.0 | 0.0 | 70.2 | 52 | 11.5 |
| 8 | H | Described in specification | | | | | | | | | | 107.0 | 110 | 13.8 |
| 9 | I | Described in specification | | | | | | | | | | 64.5 | 32 | 29.3 |

*part(s) by mass with respect to 100.0 parts by mass of resin
TPA: terephthalic acid,
IPA: isophthalic acid,
TMA: trimellitic anhydride,
BPA-PO: bisphenol A-propylene oxide (2 mol) adduct,
EG: ethylene glycol,
DMAE: diethylaminoethanol,
DBS: sodium dodecylbenzenesulfonate <Polyester Resin A Production Example 1>

100 Parts by mass of a mixture obtained by mixing raw materials (acid components and alcohol components) in loading amounts shown in Table 2, and 0.52 part by mass of tin di(2-ethylhexanoate) as a catalyst were loaded into a 6-L four-necked flask provided with a nitrogen introducing tube, a dewatering tube, a stirrer, and a thermocouple, and were subjected to a reaction under a nitrogen atmosphere at 200° C. over 6 hours. Further, trimellitic anhydride was added to the resultant at 210° C. and the mixture was subjected to a reaction under a reduced pressure of 40 mmHg. The reaction was continued until a weight-average molecular weight (Mw) became 12,000. The resultant polyester resin A is defined as a resin (1). Table 2 shows the result of the composition analysis of the resin (1). In addition, the acid value of the resultant resin was as shown in Table 2.

The composition analysis of the polyester resin A was performed by $^{1}$H-NMR. A specific measurement method is as follows.

Measurement apparatus: FTNMR apparatus (trade name: JNM-EX400, manufactured by JEOL Ltd.)
Measurement frequency: 400 MHz
Pulse condition: 5.0 μs
Frequency range: 10,500 Hz
Number of scans: 64 scans
Measurement temperature: 30° C.

50 Milligrams of the sample was loaded into a sample tube having an inner diameter of 5 mm, and deuterated chloroform ($CDCl_3$) was added as a solvent to the tube. The sample was dissolved in a thermostat at 40° C. to prepare a measurement sample. Measurement was performed with the measurement sample under the foregoing conditions.

<Polyester Resin A Production Examples 2 to 8>

Production was performed in the same manner as in Polyester Resin A Production Example 1 except that the loading amounts of the acid components and the alcohol components were changed as shown in Table 2. Table 2 shows the acid values of resins (2) to (8) as well.

TABLE 2

| | | | Resin (1) | Resin (2) | Resin (3) | Resin (4) | Resin (5) | Resin (6) | Resin (7) | Resin (8) |
|---|---|---|---|---|---|---|---|---|---|---|
| Loading amount (mol) | Acid component | TPA | 3.105 | 3.118 | 3.119 | 2.906 | 3.353 | 3.117 | 3.119 | 3.125 |
| | | IPA | 3.105 | 3.077 | 3.091 | 2.896 | 3.176 | 3.099 | 3.099 | 3.085 |
| | | TMA | 0.140 | 0.140 | 0.140 | 0.140 | 0.140 | 0.140 | 0.140 | 0.140 |
| | Alcohol component | BPA(PO) | 4.769 | 5.144 | 2.220 | 4.112 | 4.054 | 5.350 | 2.399 | 5.320 |
| | | BPA(EO) | 1.193 | 1.863 | 2.462 | 1.909 | 1.915 | 2.093 | 2.065 | 2.092 |
| | | Isosorbide | 1.490 | 0.446 | 2.772 | 1.430 | 1.482 | 0.012 | 2.987 | 0.060 |
| Resin composition * (molar ratio) | Acid component | TPA | 45.00 | 45.20 | 45.20 | 42.10 | 48.60 | 45.20 | 45.20 | 45.10 |
| | | IPA | 44.20 | 43.80 | 44.00 | 41.20 | 45.20 | 44.10 | 44.10 | 44.40 |
| | | TMA | 1.30 | 1.30 | 1.30 | 1.30 | 1.30 | 1.30 | 1.30 | 1.30 |
| | Alcohol component (Total = 100) | BPA(PO) | 64.00 | 69.00 | 22.00 | 55.20 | 54.40 | 69.10 | 17.20 | 71.30 |
| | | BPA(EO) | 16.00 | 25.00 | 23.00 | 25.60 | 25.70 | 30.80 | 17.80 | 28.10 |
| | | Isosorbide | 20.00 | 6.00 | 55.00 | 19.20 | 19.90 | 0.10 | 65.00 | 0.60 |
| Isosorbide unit (number %) | | | 10.50 | 3.15 | 28.87 | 10.40 | 10.20 | 0.05 | 34.10 | 0.31 |
| Acid value of resin (mgKOH/g) | | | 7.0 | 7.2 | 6.8 | 0.3 | 26.1 | 6.5 | 8.2 | 7.2 |

* The description of the resin composition means a molar ratio in the case where the total number of moles of the alcohol components is 100.
TPA: terephthalic acid,
IPA: isophthalic acid,
TMA: trimellitic anhydride,
BPA (PO): propylene oxide 2 mol adduct of bisphenol A,
BPA (EO): ethylene oxide 2 mol adduct of bisphenol A Example 1

Production of Toner Base Particles 850.0 Parts by mass of a 0.1 mol/L aqueous solution of $Na_3PO_4$ was added to a container provided with a high-speed stirring apparatus CLEARMIX (manufactured by M Technique Co., Ltd.), the number of revolutions of the apparatus was adjusted to 15,000 rpm, and the aqueous solution was warmed to 60° C. 68.0 Parts by mass of a 1.0 mol/L aqueous solution of $CaCl_2$ was added to the container. Thus, an aqueous medium containing fine particles of $Ca_3(PO_4)_2$ as a hardly water-soluble dispersant was prepared.

In addition, the following materials were dissolved with a propeller-type stirring apparatus at 100 rpm to prepare a solution.

| | |
|---|---|
| Styrene | 75.0 parts by mass |
| n-Butyl acrylate | 25.0 parts by mass |
| Resin (1) | 4.0 parts by mass |

Next, the following materials were added to the solution.

| | |
|---|---|
| C.I. Pigment Blue 15:3 | 6.5 parts by mass |
| Hydrocarbon wax whose peak temperature of the maximum endothermic peak is 77° C. (trade name: HNP-51, manufactured by Nippon Seiro Co., Ltd.) | 9.0 parts by mass |

After that, the mixed liquid was warmed to a temperature of 60° C., and was then stirred with a TK-type homomixer (manufactured by Tokushu Kika Kogyo Co., Ltd.) at 9,000 rpm to be dissolved and dispersed.

10.0 Parts by mass of 2,2'-azobis(2,4-dimethylvaleronitrile) as a polymerization initiator was dissolved in the resultant. Thus, a polymerizable monomer composition was prepared.

The polymerizable monomer composition was loaded into the aqueous medium, and the mixture was granulated (subjected to particle formation) at a temperature of 60° C. for 15 minutes while the CLEARMIX was rotated at 15,000 rpm.

After that, the resultant was transferred to a propeller-type stirring apparatus, and was subjected to a reaction (polymerization reaction) at a temperature of 70° C. for 5 hours while being stirred at 100 rpm. After that, the temperature of the resultant was increased to 80° C. and the resultant was further subjected to a reaction for 5 hours.

Next, 200.0 parts by mass of ion-exchanged water was added to the resultant, a reflux tube was removed, and a distilling apparatus was attached. The mixture was distilled at a temperature in the container of 100° C. for 5 hours. The amount of a distillation fraction was 700.0 parts by mass. The fraction was cooled to 30° C. to provide a polymer slurry. Ion-exchanged water was added to the slurry to adjust the concentration of polymer particles in a dispersion liquid to 20 mass %. Thus, a dispersion liquid of toner base particles (A) was obtained.

A small amount of the resultant dispersion liquid of the toner base particles (A) was extracted. 10 mass % hydrochloric acid was added to the dispersion liquid to adjust its pH to 1.5, and the mixture was stirred for 2 hours. After that, the mixture was washed with ion-exchanged water, filtered, and dried, followed by the measurement of the glass transition temperature Tg1 of the toner base particles.

(Fixing of Resin Particles)

500.0 Parts by mass (solid content: 100.0 parts by mass) of the dispersion liquid of the toner base particles (A) was loaded into a reaction vessel provided with a reflux cooling tube, a stirrer, and a thermometer. Then, while the dispersion liquid was stirred, 2.5 parts by mass (solid content: 0.5 part by mass) of the dispersion liquid of the resin particles A was added to the dispersion liquid, and the mixture was stirred at 200 rpm for 15 minutes. Next, the temperature of the dispersion liquid of the toner base particles (A) to which the resin particles had adhered was held at 75° C. (heating temperature) with a heating oil bath, and stirring was continued for 1 hour. After that, the dispersion liquid was cooled to 20° C. and then 10 mass % hydrochloric acid was added to the dispersion liquid until its pH became 1.5, followed by stirring for 2 hours. Further, the mixture was washed with ion-exchanged water, and was then filtered, dried, and classified. Thus, toner particles (A) were obtained. Herein, it was confirmed that almost all of resin particles were fixed to toner base particles, by observing dispersion medium and the resin particles.

100.0 Parts by mass of the toner particles (A), and 2.0 parts by mass of hydrophobic silica fine particles that had been treated with a dimethyl silicone oil (20 mass %) as a flowability improver and were to be triboelectrically charged to the same polarity as that of the toner particles (negative polarity) (number-average primary particle diameter: 10 nm, BET specific surface area: 170 $m^2/g$) were loaded into a HENSCHEL® mixer (manufactured by Mitsui Miike Machinery Co., Ltd.), and were mixed at 3,000 rpm for 15 minutes. Thus, a toner (A) was obtained.

Example 2

A toner was produced in the same manner as in Example except that in Example 1, 80.0 parts by mass of a polystyrene resin having a peak molecular weight (Mp) of 3,000 was added at the time of the production of the toner base particles. The resultant toner is defined as a toner (B).

Example 3

A toner was produced in the same manner as in Example except that in Example 2, 80.0 parts by mass of the polystyrene resin was changed to 80.0 parts by mass of a polyester resin obtained from a propylene oxide 2 mol adduct of bisphenol A and terephthalic acid (Mp: 3,500). The resultant toner is defined as a toner (C).

Example 4

A toner was produced in the same manner as in Example 1 except that in Example 1, the resin (1) was changed to the resin (2) and the addition amount of the resin (2) was changed to 1.5 parts by mass. The resultant toner is defined as a toner (D).

Example 5

A toner was produced in the same manner as in Example 1 except that in Example 1, the resin (1) was changed to the resin (3) and the addition amount of the resin (3) was changed to 1.5 parts by mass. The resultant toner is defined as a toner (E).

Example 6

A toner was produced in the same manner as in Example 1 except that in Example 1, the resin (1) was changed to the resin (2) and the addition amount of the resin (2) was changed to 60.0 parts by mass. The resultant toner is defined as a toner (F).

Example 7

A toner was produced in the same manner as in Example 1 except that in Example 1, the resin (1) was changed to the resin (3) and the addition amount of the resin (3) was changed to 60.0 parts by mass. The resultant toner is defined as a toner (G).

Example 8

A toner was produced in the same manner as in Example except that in Example 1, 2.5 parts by mass (solid content: 0.5 part by mass) of the dispersion liquid of the resin particles A was changed to 0.5 part by mass (solid content: 0.1 part by mass) of the dispersion liquid of the resin particles A. The resultant toner is defined as a toner (H).

Example 9

A toner was produced in the same manner as in Example except that in Example 1, 2.5 parts by mass (solid content: 0.5 part by mass) of the dispersion liquid of the resin particles A was changed to 25.0 parts by mass (solid content: 5.0 parts by mass) of the dispersion liquid of the resin particles A. The resultant toner is defined as a toner (I).

Example 10

A toner was produced in the same manner as in Example 1 except that in Example 1, the resin (1) was changed to the resin (4). The resultant toner is defined as a toner (J).

Example 11

A toner was produced in the same manner as in Example 1 except that in Example 1, the resin (1) was changed to the resin (5). The resultant toner is defined as a toner (K).

Example 12

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles B, and the heating temperature was changed from 75° C. to 60° C. The resultant toner is defined as a toner (L).

Example 13

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles H, and the heating temperature was changed from 75° C. to 100° C. The resultant toner is defined as a toner (M).

Example 14

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles C. The resultant toner is defined as a toner (N).

Example 15

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles D. The resultant toner is defined as a toner (O).

Example 16

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles E. The resultant toner is defined as a toner (P).

Example 17

A toner was produced in the same manner as in Example except that in Example 1, 2.5 parts by mass (solid content: 0.5 part by mass) of the dispersion liquid of the resin particles A was changed to 10.0 parts by mass (solid content: 2.0 parts by mass) of the dispersion liquid of the resin particles F. The resultant toner is defined as a toner (Q).

Example 18

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles G. The resultant toner is defined as a toner (R).

Example 19

A toner was produced in the same manner as in Example except that in Example 1, 2.5 parts by mass (solid content: 0.5 part by mass) of the dispersion liquid of the resin particles A was changed to 2.5 parts by mass (solid content: 0.5 part by mass) of the dispersion liquid of the resin particles I. The resultant toner is defined as a toner (S).

Example 20

A toner was produced by a dissolution suspension method in accordance with the following procedure.

First, an aqueous medium and a solution were prepared in accordance with the following procedure, and the toner was produced.

660.0 Parts by mass of water and 25.0 parts by mass of a 48.5 mass % aqueous solution of sodium dodecyl diphenyl ether disulfonate were mixed. The mixture was loaded into a TK-type homomixer (manufactured by Tokushu Kika Kogyo Co., Ltd.) and stirred at 10,000 rpm to prepare the aqueous medium.

In addition, the following materials were loaded into 500 parts by mass of ethyl acetate, and were dissolved with a propeller-type stirring apparatus at 100 rpm to prepare the solution.

| | |
|---|---|
| Copolymer of styrene and n-butyl acrylate (copolymerization ratio: styrene/n-butyl acrylate = 75/25, Mp: 17,000) | 100.0 parts by mass |
| Resin (1) | 4.0 parts by mass |
| C.I. Pigment Blue 15:3 | 6.5 parts by mass |
| Hydrocarbon wax whose peak temperature of the maximum endothermic peak is 77° C. (trade name: HNP-51, manufactured by Nippon Seiro Co., Ltd.) | 9.0 parts by mass |

Next, 150.0 parts by mass of the aqueous medium was loaded into a container and stirred with a TK-type homomixer (manufactured by Tokushu Kika Kogyo Co., Ltd.) at a number of revolutions of 12,000 rpm. 100 Parts by mass of the solution was added to the aqueous medium, and the contents were mixed for 10 minutes to prepare an emulsified slurry.

After that, 100 parts by mass of the emulsified slurry was loaded into a flask set with a piping for deaeration, a stirrer, and a thermometer, and the solvent was removed at 30° C. for 12 hours under reduced pressure with stirring at a stirring peripheral speed of 20 m/min, followed by aging at 45° C. for 4 hours. Thus, a slurry from which the solvent had been removed was obtained. The slurry from which the solvent had been removed was filtered under reduced pressure, 300.0 parts by mass of ion-exchanged water was then added to the resultant filter cake, and the contents were mixed and redispersed with a TK-type homomixer (at a number of revolutions of 12,000 rpm for 10 minutes), followed by filtration. The resultant filter cake was dried with a dryer at 45° C. for 48 hours, and the dried product was sieved with a mesh having an aperture of 75 μm. Thus, toner base particles (T) were obtained. Part of the resultant toner base particles (T) were extracted and their glass transition temperature Tg1 was measured.

850.0 Parts by mass of a 0.1 mol/L aqueous solution of $Na_3PO_4$ was added to a container provided with a high-speed stirring apparatus (trade name: CLEARMIX, manufactured by M Technique Co., Ltd.), the number of revolutions of the apparatus was adjusted to 15,000 rpm, and the aqueous solution was warmed to 60° C. 68.0 Parts by mass of a 1.0 mol/L aqueous solution of $CaCl_2$ was added to the container. Thus, an aqueous medium containing fine particles of $Ca_3(PO_4)_2$ as a hardly water-soluble dispersant was prepared.

250.0 Parts by mass of the toner base particles (T) was loaded into the aqueous medium, and was dispersed at a temperature of 60° C. for 15 minutes while the CLEARMIX was rotated at 15,000 rpm. Ion-exchanged water was added to the dispersion liquid to adjust the concentration of the toner base particles in the dispersion liquid to 20 mass %. Thus, a dispersion liquid of the toner base particles (T) was obtained.

500.0 Parts by mass (solid content: 100.0 parts by mass) of the dispersion liquid of the toner base particles (T) was loaded into a reaction vessel provided with a reflux cooling tube, a stirrer, and a thermometer. Then, while the dispersion liquid was stirred, 2.5 parts by mass (solid content: 0.5 part by mass) of the dispersion liquid of the resin particles A was added to the dispersion liquid, and the mixture was stirred at 200 rpm for 15 minutes. Next, the temperature of the dispersion liquid of the toner base particles to which the resin particles had adhered was held at 75° C. (heating temperature) with a heating oil bath, and stirring was continued for 1 hour. After that, the dispersion liquid was cooled to 20° C. and then 10 mass % hydrochloric acid was added to the dispersion liquid until its pH became 1.5, followed by stirring for 2 hours. Further, the mixture was washed with ion-exchanged water, and was then filtered, dried, and classified. Thus, toner particles (T) were obtained.

100.0 Parts by mass of the toner particles (T), and 2.0 parts by mass of hydrophobic silica fine particles that had been treated with a dimethyl silicone oil (20 mass %) as a flowability improver and were to be triboelectrically charged to the same polarity as that of the toner particles (negative polarity) (number-average primary particle diameter: 10 nm, BET specific surface area: 170 $m^2/g$) were loaded into a HENSCHEL® mixer (manufactured by Mitsui Miike Machinery Co., Ltd.), and were mixed at 3,000 rpm for 15 minutes. Thus, a toner (T) was obtained.

Example 21

A toner was produced by an emulsion aggregation method in accordance with the following procedure.

[Preparation of Resin Particle Dispersion Liquid]

100.0 Parts by mass of a copolymer of styrene and n-butyl acrylate (copolymerization ratio: styrene/n-butyl acrylate=75/25, Mp: 17,000) and 3.8 parts by mass of the resin (1) were dissolved in 250 parts by mass of tetrahydrofuran. 1,000 Parts by mass of ion-exchanged water was dropped to the tetrahydrofuran solution while the solution was stirred at room temperature. Tetrahydrofuran was removed by warming the mixed solution to 75° C. Thus, a resin particle dispersion liquid having an average particle diameter of 0.09 μm was obtained.

[Preparation of Wax Component Particle Dispersion Liquid]

| | |
|---|---|
| Hydrocarbon wax whose peak temperature of the maximum endothermic peak is 77° C. (trade name: HNP-51, manufactured by Nippon Seiro Co., Ltd.) | 9.0 parts by mass |
| Ion-exchanged water | 50.0 parts by mass |

The foregoing materials were heated to 95° C. and were dispersed with a homogenizer (trade name: ULTRA-TURRAX T50, manufactured by IKA). After that, the resultant was subjected to a dispersion treatment with a pressure ejection-type homogenizer. Thus, a wax component particle dispersion liquid having dispersed therein the wax component having an average particle diameter of 0.51 μm was prepared.

[Preparation of Colorant Particle Dispersion Liquid]

| | |
|---|---|
| C.I. Pigment Blue 15:3 | 6.5 parts by mass |
| Anionic surfactant (trade name: NEOGEN SC, manufactured by Dai-ichi Kogyo Seiyaku Co., Ltd.) | 2.0 parts by mass |
| Ion-exchanged water | 78.0 parts by mass |

The foregoing materials were mixed and were dispersed with a sand grinder mill. A particle size distribution in the colorant particle dispersion liquid was measured with a particle size measuring apparatus (trade name: LA-700, manufactured by Horiba, Ltd.). As a result, the average particle diameter of the colorant particles in the dispersion liquid was 0.21 μm, and no coarse particles each having a diameter of more than 1 μm were observed.

[Preparation of Mixed Liquid]

The total amounts of the resin particle dispersion liquid, the colorant particle dispersion liquid, and the wax component particle dispersion liquid were mixed. The mixture was loaded into a 5-L separable flask equipped with a stirring apparatus, a cooling tube, and a thermometer, and was stirred. The pH of the mixed liquid was adjusted to 5.2 with 1 mol/L potassium hydroxide.

[Formation of Aggregated Particles]

2.0 Parts by mass of a 10 mass % aqueous solution of sodium chloride as an aggregating agent was dropped to the mixed liquid, and the mixture in the flask was heated to 50° C. in a heating oil bath while being stirred. After the temperature had been held for 30 minutes, the mixture was warmed to 55° C. and the temperature was further held for 30 minutes.

[Fusion Step]

After that, 70.0 parts by mass of a 15 mass % aqueous solution of a dodecylbenzenesulfonate was slowly added to the mixture. The resultant liquid was warmed to a temperature of 80° C. and the temperature was held for 5 hours. After having been cooled, the liquid was filtered and washed with ion-exchanged water. After that, the washed product was dried to provide toner base particles (U). Part of the resultant toner base particles (U) were extracted and their glass transition temperature Tg1 was measured.

850.0 Parts by mass of a 0.1 mol/L aqueous solution of $Na_3PO_4$ was added to a container provided with a high-speed stirring apparatus (trade name: CLEARMIX, manufactured by M Technique Co., Ltd.), the number of revolutions of the apparatus was adjusted to 15,000 rpm, and the aqueous solution was warmed to 60° C. 68.0 Parts by mass of a 1.0 mol/L aqueous solution of $CaCl_2$ was added to the container. Thus, an aqueous medium containing fine particles of $Ca_3(PO_4)_2$ as a hardly water-soluble dispersant was prepared.

250.0 Parts by mass of the toner base particles (U) was loaded into the aqueous medium, and was dispersed at a temperature of 60° C. for 15 minutes while the CLEARMIX was rotated at 15,000 rpm. Ion-exchanged water was added to the dispersion liquid to adjust the concentration of the toner base particles in the dispersion liquid to 20 mass %. Thus, a dispersion liquid of the toner base particles (U) was obtained.

500.0 Parts by mass (solid content: 100.0 parts by mass) of the dispersion liquid of the toner base particles (U) was loaded into a reaction vessel provided with a reflux cooling tube, a stirrer, and a thermometer. Then, while the dispersion liquid was stirred, 2.5 parts by mass (solid content: 0.5 part by mass) of the dispersion liquid of the resin particles A was added to the dispersion liquid, and the mixture was stirred at 200 rpm for 15 minutes. Next, the temperature of the dispersion liquid of the toner base particles to which the resin particles had adhered was held at 75° C. (heating temperature) with a heating oil bath, and stirring was continued for 1 hour. After that, the dispersion liquid was cooled to 20° C. and then 10 mass % hydrochloric acid was added to the dispersion liquid until its pH became 1.5, followed by stirring for 2 hours. Further, the mixture was washed with ion-exchanged water, and was then filtered, dried, and classified. Thus, toner particles (U) were obtained.

100.0 Parts by mass of the toner particles (U), and 2.0 parts by mass of hydrophobic silica fine particles that had been treated with a dimethyl silicone oil (20 mass %) as a flowability improver and were to be triboelectrically charged to the same polarity as that of the toner particles (negative polarity) (number-average primary particle diameter: 10 nm, BET specific surface area: 170 $m^2/g$) were loaded into a HENSCHEL® mixer (manufactured by Mitsui Miike Machinery Co., Ltd.), and were mixed at 3,000 rpm for 15 minutes. Thus, a toner (U) was obtained.

Example 22

A toner was produced by a pulverizing method in accordance with the following procedure.

100.0 Parts by mass of a copolymer of styrene and n-butyl acrylate (copolymerization ratio: styrene/n-butyl acrylate=75/25, Mp: 17,000), 3.8 parts by mass of the resin (1), 6.5 parts by mass of C.I. Pigment Blue 15:3, and 9.0 parts by mass of a hydrocarbon wax whose peak temperature of the maximum endothermic peak is 77° C. (trade name: HNP-51, manufactured by Nippon Seiro Co., Ltd.) were melt-kneaded and pulverized to provide toner base particles (V).

Part of the resultant toner base particles (V) were extracted and their glass transition temperature Tg1 was measured.

850.0 Parts by mass of a 0.1 mol/L aqueous solution of $Na_3PO_4$ was added to a container provided with a high-speed stirring apparatus (trade name: CLEARMIX, manufactured by M Technique Co., Ltd.), the number of revolutions of the apparatus was adjusted to 15,000 rpm, and the aqueous solution was warmed to 60° C. 68.0 Parts by mass of a 1.0 mol/L aqueous solution of $CaCl_2$ was added to the container. Thus, an aqueous medium containing fine particles of $Ca_3(PO_4)_2$ as a hardly water-soluble dispersant was prepared.

250.0 Parts by mass of the toner base particles (V) was loaded into the aqueous medium, and was dispersed at a temperature of 60° C. for 15 minutes while the CLEARMIX was rotated at 15,000 rpm. Ion-exchanged water was added to the dispersion liquid to adjust the concentration of the toner base particles in the dispersion liquid to 20 mass %. Thus, a dispersion liquid of the toner base particles (V) was obtained.

500.0 Parts by mass (solid content: 100.0 parts by mass) of the dispersion liquid of the toner base particles (V) was loaded into a reaction vessel provided with a reflux cooling tube, a stirrer, and a thermometer. Then, while the dispersion liquid was stirred, 2.5 parts by mass (solid content: 0.5 part by mass) of the dispersion liquid of the resin particles A was added to the dispersion liquid, and the mixture was stirred at 200 rpm for 15 minutes. Next, the temperature of the dispersion liquid of the toner base particles to which the resin particles had adhered was held at 75° C. (heating temperature) with a heating oil bath, and stirring was continued for 1 hour. After that, the dispersion liquid was cooled to 20° C. and then 10 mass % hydrochloric acid was added to the dispersion liquid until its pH became 1.5, followed by stirring for 2 hours. Further, the mixture was washed with ion-exchanged water, and was then filtered, dried, and classified. Thus, toner particles (V) were obtained.

100.0 Parts by mass of the toner particles, and 2.0 parts by mass of hydrophobic silica fine particles that had been treated with a dimethyl silicone oil (20 mass %) as a flowability improver and were to be triboelectrically charged to the same polarity as that of the toner particles (negative polarity) (number-average primary particle diameter: 10 nm, BET specific surface area: 170 $m^2/g$) were loaded into a HENSCHEL® mixer (manufactured by Mitsui Miike Machinery Co., Ltd.), and were mixed at 300 rpm for 15 minutes. Thus, a toner (V) was obtained.

Example 23

A toner was produced in the same manner as in Example 1 except that in Example 1, the resin (1) was changed to the resin (8). The resultant toner is defined as a toner (W).

Comparative Example 1

A toner was produced in the same manner as in Example 1 except that in Example 1, the resin (1) was changed to the resin (2) and the addition amount of the resin (2) was changed to 70.0 parts by mass. The resultant toner is defined as a toner (a).

Comparative Example 2

A toner was produced in the same manner as in Example 1 except that in Example 1, the resin (1) was changed to the resin (3) and the addition amount of the resin (3) was changed to 70.0 parts by mass. The resultant toner is defined as a toner (b).

Comparative Example 3

A toner was produced in the same manner as in Example 1 except that in Example 1, the resin (1) was changed to the resin (2) and the addition amount of the resin (2) was changed to 0.5 part by mass. The resultant toner is defined as a toner (c).

Comparative Example 4

A toner was produced in the same manner as in Example 1 except that in Example 1, the resin (1) was changed to the resin (3) and the addition amount of the resin (3) was changed to 0.5 part by mass. The resultant toner is defined as a toner (d).

Comparative Example 5

A toner was produced in the same manner as in Example 1 except that in Example 1, the resin (1) was changed to the resin (6) and the addition amount of the resin (6) was changed to 60.0 parts by mass. The resultant toner is defined as a toner (e).

Comparative Example 6

A toner was produced in the same manner as in Example 1 except that in Example 1, the resin (1) was changed to the resin (6) and the addition amount of the resin (6) was changed to 1.5 parts by mass. The resultant toner is defined as a toner (f).

Comparative Example 7

A toner was produced in the same manner as in Example 1 except that in Example 1, the resin (1) was changed to the resin (7) and the addition amount of the resin (7) was changed to 1.5 parts by mass. The resultant toner is defined as a toner (g).

Comparative Example 8

A toner was produced in the same manner as in Example 1 except that in Example 1, the resin (1) was changed to the resin (7) and the addition amount of the resin (7) was changed to 60.0 parts by mass. The resultant toner is defined as a toner (h).

Comparative Example 9

A toner was produced in the same manner as in Example except that in Example 1, the addition amount of the resin (1) was changed to 8.0 parts by mass, and at the time of the production of the toner base particles, 100.0 parts by mass of a polystyrene resin (Mp: 5,000) was added. The resultant toner is defined as a toner (i).

Table 3 shows the polyester resin A (kind and content) and styrene-acrylic resin (content and peak molecular weight) in the toner, and the glass transition temperature Tg1 for each of the toner base particles (A) to (W) and (a) to (i).

Further, Table 4 shows conditions for the fixing of resin particles for the toners (A) to (W) and (a) to (i). Herein, it was confirmed that in all of toner particles, almost all of resin particles were fixed to surfaces of toner base particles, by observing dispersion medium and the resin particles.

TABLE 3

| | | Polyester resin A | | Styrene-acrylic resin | | | |
|---|---|---|---|---|---|---|---|
| | Toner base particles | Kind | Content (part(s)) | Content (part(s)) | Peak molecular weight | Tg1 (° C.) | Production method |
| Example 1 | Toner base particles (A) | Resin (1) | 3.8 | 96.2 | 17,100 | 52.5 | Suspension polymerization method |
| Example 2 | Toner base particles (B) | Resin (1) | 2.2 | 54.3 | 17,000 | 54.8 | Suspension polymerization method |
| Example 3 | Toner base particles (C) | Resin (1) | 2.2 | 54.3 | 17,200 | 55.7 | Suspension polymerization method |
| Example 4 | Toner base particles (D) | Resin (2) | 1.5 | 98.5 | 17,500 | 51.6 | Suspension polymerization method |
| Example 5 | Toner base particles (E) | Resin (3) | 1.5 | 98.5 | 16,900 | 50.8 | Suspension polymerization method |
| Example 6 | Toner base particles (F) | Resin (2) | 37.5 | 62.5 | 17,000 | 55.0 | Suspension polymerization method |
| Example 7 | Toner base particles (G) | Resin (3) | 37.5 | 62.5 | 17,500 | 55.5 | Suspension polymerization method |
| Example 8 | Toner base particles (H) | Resin (1) | 3.8 | 96.2 | 17,100 | 52.5 | Suspension polymerization method |
| Example 9 | Toner base particles (I) | Resin (1) | 3.8 | 96.2 | 17,100 | 52.5 | Suspension polymerization method |
| Example 10 | Toner base particles (J) | Resin (4) | 3.8 | 96.2 | 16,800 | 52.0 | Suspension polymerization method |
| Example 11 | Toner base particles (K) | Resin (5) | 3.8 | 96.2 | 16,600 | 51.6 | Suspension polymerization method |
| Example 12 | Toner base particles (L) | Resin (1) | 3.8 | 96.2 | 17,100 | 52.5 | Suspension polymerization method |
| Example 13 | Toner base particles (M) | Resin (1) | 3.8 | 96.2 | 17,100 | 52.5 | Suspension polymerization method |
| Example 14 | Toner base particles (N) | Resin (1) | 3.8 | 96.2 | 17,100 | 52.5 | Suspension polymerization method |
| Example 15 | Toner base particles (O) | Resin (1) | 3.8 | 96.2 | 17,100 | 52.5 | Suspension polymerization method |
| Example 16 | Toner base particles (P) | Resin (1) | 3.8 | 96.2 | 17,100 | 52.5 | Suspension polymerization method |
| Example 17 | Toner base particles (Q) | Resin (1) | 3.8 | 96.2 | 17,100 | 52.5 | Suspension polymerization method |
| Example 18 | Toner base particles (R) | Resin (1) | 3.8 | 96.2 | 17,100 | 52.5 | Suspension polymerization method |

TABLE 3-continued

| | | Polyester resin A | | Styrene-acrylic resin | | | |
|---|---|---|---|---|---|---|---|
| | Toner base particles | Kind | Content (part(s)) | Content (part(s)) | Peak molecular weight | Tg1 (° C.) | Production method |
| Example 19 | Toner base particles (S) | Resin (1) | 3.8 | 96.2 | 17,100 | 52.5 | Suspension polymerization method |
| Example 20 | Toner base particles (T) | Resin (1) | 3.8 | 96.2 | 17,000 | 51.8 | Dissolution suspension method |
| Example 21 | Toner base particles (U) | Resin (1) | 3.8 | 96.2 | 17,000 | 52.1 | Emulsion aggregation method |
| Example 22 | Toner base particles (V) | Resin (1) | 3.8 | 96.2 | 17,000 | 52.0 | Pulverizing method |
| Example 23 | Toner base particles (W) | Resin (8) | 3.8 | 96.2 | 17,200 | 52.3 | Suspension polymerization method |
| Comparative Example 1 | Toner base particles (a) | Resin (2) | 41.2 | 58.8 | 17,400 | 57.2 | Suspension polymerization method |
| Comparative Example 2 | Toner base particles (b) | Resin (3) | 41.2 | 58.8 | 17,000 | 56.9 | Suspension polymerization method |
| Comparative Example 3 | Toner base particles (c) | Resin (2) | 0.5 | 99.5 | 16,900 | 51.0 | Suspension polymerization method |
| Comparative Example 4 | Toner base particles (d) | Resin (3) | 0.5 | 99.5 | 17,500 | 51.1 | Suspension polymerization method |
| Comparative Example 5 | Toner base particles (e) | Resin (6) | 37.5 | 62.5 | 17,200 | 56.2 | Suspension polymerization method |
| Comparative Example 6 | Toner base particles (f) | Resin (6) | 1.5 | 98.5 | 17,100 | 52.0 | Suspension polymerization method |
| Comparative Example 7 | Toner base particles (g) | Resin (7) | 1.5 | 98.5 | 17,100 | 51.4 | Suspension polymerization method |
| Comparative Example 8 | Toner base particles (h) | Resin (7) | 37.5 | 62.5 | 17,300 | 56.0 | Suspension polymerization method |
| Comparative Example 9 | Toner base particles (i) | Resin (1) | 3.8 | 48.1 | 17,200 | 56.5 | Suspension polymerization method |

"Part(s)" refers to "part(s) by mass".

TABLE 4

| | | Condition for fixing of resin particles | | | |
|---|---|---|---|---|---|
| | Toner | Toner base particles | Resin particles | Resin particle solid content (part(s)) | Heating temperature (° C.) |
| Example 1 | Toner (A) | Toner base particles (A) | Resin particles A | 0.5 | 75 |
| Example 2 | Toner (B) | Toner base particles (B) | Resin particles A | 0.5 | 75 |
| Example 3 | Toner (C) | Toner base particles (C) | Resin particles A | 0.5 | 75 |
| Example 4 | Toner (D) | Toner base particles (D) | Resin particles A | 0.5 | 75 |
| Example 5 | Toner (E) | Toner base particles (E) | Resin particles A | 0.5 | 75 |
| Example 6 | Toner (F) | Toner base particles (F) | Resin particles A | 0.5 | 75 |
| Example 7 | Toner (G) | Toner base particles (G) | Resin particles A | 0.5 | 75 |
| Example 8 | Toner (H) | Toner base particles (H) | Resin particles A | 0.1 | 75 |
| Example 9 | Toner (I) | Toner base particles (I) | Resin particles A | 5.0 | 75 |
| Example 10 | Toner (J) | Toner base particles (J) | Resin particles A | 0.5 | 75 |
| Example 11 | Toner (K) | Toner base particles (K) | Resin particles A | 0.5 | 75 |
| Example 12 | Toner (L) | Toner base particles (L) | Resin particles B | 0.5 | 60 |
| Example 13 | Toner (M) | Toner base particles (M) | Resin particles H | 0.5 | 100 |
| Example 14 | Toner (N) | Toner base particles (N) | Resin particles C | 0.5 | 75 |
| Example 15 | Toner (O) | Toner base particles (O) | Resin particles D | 0.5 | 75 |
| Example 16 | Toner (P) | Toner base particles (P) | Resin particles E | 0.5 | 75 |
| Example 17 | Toner (Q) | Toner base particles (Q) | Resin particles F | 2.0 | 75 |
| Example 18 | Toner (R) | Toner base particles (R) | Resin particles G | 0.5 | 75 |
| Example 19 | Toner (S) | Toner base particles (S) | Resin particles I | 0.5 | 75 |
| Example 20 | Toner (T) | Toner base particles (T) | Resin particles A | 0.5 | 75 |
| Example 21 | Toner (U) | Toner base particles (U) | Resin particles A | 0.5 | 75 |
| Example 22 | Toner (V) | Toner base particles (V) | Resin particles A | 0.5 | 75 |
| Example 23 | Toner (W) | Toner base particles (W) | Resin particles A | 0.5 | 75 |
| Comparative Example 1 | Toner (a) | Toner base particles (a) | Resin particles A | 0.5 | 75 |
| Comparative Example 2 | Toner (b) | Toner base particles (b) | Resin particles A | 0.5 | 75 |
| Comparative Example 3 | Toner (c) | Toner base particles (c) | Resin particles A | 0.5 | 75 |
| Comparative Example 4 | Toner (d) | Toner base particles (d) | Resin particles A | 0.5 | 75 |
| Comparative Example 5 | Toner (e) | Toner base particles (e) | Resin particles A | 0.5 | 75 |
| Comparative Example 6 | Toner (f) | Toner base particles (f) | Resin particles A | 0.5 | 75 |
| Comparative Example 7 | Toner (g) | Toner base particles (g) | Resin particles A | 0.5 | 75 |
| Comparative Example 8 | Toner (h) | Toner base particles (h) | Resin particles A | 0.5 | 75 |
| Comparative Example 9 | Toner (i) | Toner base particles (i) | Resin particles A | 0.5 | 75 |

"Part(s)" refers to "part(s) by mass".

Each of the toners obtained in Examples 1 to 23 and Comparative Examples 1 to 9 was evaluated for its performance in accordance with the following methods. Table 5 collectively shows the results.

(Evaluations for Image Density and Fogging)

70 Grams of a toner was loaded into a developer container in an image forming apparatus (trade name: Satera LBP5300, manufactured by Canon Inc.) including a developing apparatus of a one-component contact development system illustrated in FIG. 1. It should be noted that 75-g/m$^2$ paper (trade name: Xerox4200, manufactured by Xerox Corporation) was used as transfer paper (a recording medium).

The developing apparatus illustrated in FIG. 1 was mounted on the unit 104*a* in FIG. 2 under each of the following three environments: a low-temperature and low-humidity environment (having a temperature of 10° C. and a humidity of 15% RH), a normal-temperature and normal-humidity environment (having a temperature of 23° C. and a humidity of 60% RH), and a high-temperature and high-humidity environment (having a temperature of 30° C. and a humidity of 85% RH). Image formation was performed according to a cyan monochromatic mode at a process speed of 150 mm/sec. A solid image (image print percentage: 4 area %) was continuously output on 5,000 sheets of the transfer paper so that a toner laid-on level became 0.40 mg/cm$^2$, and the image density and fogging of each of the images on the first sheet and the 5,000-th sheet were measured.

(Method of Measuring Image Density)

An evaluation was performed based on the image density of a solid portion. A Macbeth reflection densitometer RD918 (trade name) (manufactured by Macbeth) was used in image density measurement, and the density of an output image relative to a white ground portion (non-image portion) having a density of 0.00 was measured.

(Method of Measuring Fogging)

The reflectance (%) of the non-image portion of an output image was measured with a "REFLECTOMETER MODEL TC-6DS" (manufactured by Tokyo Denshoku Co., Ltd.). An evaluation was performed with a numerical value (%) obtained by subtracting the resultant reflectance from the reflectance (%) of unused paper (standard paper) measured in the same manner. When the numerical value is smaller, the fogging is suppressed to a larger extent.

Table 5 shows the results of the evaluations for the image density and fogging under each of the three environments. The symbols LL, NN, and HH in Table 5 represent the low-temperature and low-humidity environment, the normal-temperature and normal-humidity environment, and the high-temperature and high-humidity environment, respectively. Numerical values shown in Table 5 are numerical values for the first sheet/the 5,000-th sheet.

(Evaluations for Density Unevenness (Density Uniformity))

70 Grams of a toner was loaded into a developer container in an image forming apparatus (trade name: Satera LBP5300, manufactured by Canon Inc.) including a developing apparatus of a one-component contact development system illustrated in FIG. 1. It should be noted that 75-g/m$^2$ paper (trade name: Xerox4200, manufactured by Xerox Corporation) was used as transfer paper (a recording medium).

The developing apparatus illustrated in FIG. 1 was mounted on the unit 104*a* in FIG. 2 under a high-temperature and high-humidity (HH) environment (having a temperature of 30° C. and a humidity of 85% RH). Image formation was performed according to a cyan monochromatic mode at a process speed of 150 mm/sec. A solid image (image print percentage: 4 area %) was continuously output on 5,000 sheets of the transfer paper so that a toner laid-on level became 0.40 mg/cm$^2$.

After that, the fixing apparatus of the image forming apparatus was removed, and was reconstructed so as to be capable of outputting an unfixed image.

A solid image was output as an unfixed image under an environment having a temperature of 23° C. and a humidity of 50% RH so that a toner laid-on level became 0.7 mg/cm$^2$. An image region was adjusted so that a margin having a width of 80 mm was formed on each of left and right sides, and a margin having a width of 10 mm was formed on each of upper and lower sides.

Next, the fixing apparatus removed from the image forming apparatus was reconstructed so that its fixation temperature and process speed could be regulated, and the unfixed image was fixed under the conditions of a fixation temperature of 170° C. and a process speed of 160 mm/sec. The transmission densities of the fixed image were measured at 10 sites selected so as to be arranged at an equal interval in a sub-scanning direction. The transmission densities were measured with a transmission densitometer (trade name: TD-904, manufactured by Macbeth).

The evaluation for density unevenness was performed by calculating a difference (ΔD) between the maximum value and minimum value of the measured values of the transmission densities at the 10 sites. Table 5 shows the results of the evaluation.

TABLE 5

| | | Image density | | | Fogging | | | Density |
|---|---|---|---|---|---|---|---|---|
| | Toner | LL | NN | HH | LL | NN | HH | unevenness |
| Example 1 | Toner (A) | 1.45/1.42 | 1.48/1.45 | 1.48/1.48 | 0.01/0.02 | 0.00/0.01 | 0.01/0.05 | 0.02 |
| Example 2 | Toner (B) | 1.44/1.42 | 1.48/1.45 | 1.46/1.45 | 0.02/003 | 0.02/0.03 | 0.02/0.06 | 0.02 |
| Example 3 | Toner (C) | 1.47/1.41 | 1.44/1.42 | 1.38/1.36 | 0.01/0.02 | 0.02/0.03 | 0.06/0.09 | 0.04 |
| Example 4 | Toner (D) | 1.47/1.36 | 1.44/1.40 | 1.38/1.32 | 0.20/0.29 | 0.02/0.05 | 0.06/0.11 | 0.03 |
| Example 5 | Toner (E) | 1.45/1.42 | 1.48/1.45 | 1.48/1.48 | 0.01/0.02 | 0.00/0.01 | 0.01/0.05 | 0.02 |
| Example 6 | Toner (F) | 1.43/1.42 | 1.41/1.40 | 1.36/1.35 | 0.04/0.05 | 0.10/0.16 | 0.30/0.39 | 0.04 |
| Example 7 | Toner (G) | 1.40/1.39 | 1.41/1.39 | 1.34/1.32 | 0.04/0.05 | 0.10/0.33 | 0.46/0.75 | 0.04 |
| Example 8 | Toner (H) | 1.43/1.40 | 1.45/1.42 | 1.47/1.46 | 0.02/0.04 | 0.01/0.02 | 0.03/0.06 | 0.07 |
| Example 9 | Toner (I) | 1.45/1.41 | 1.48/1.44 | 1.48/1.47 | 0.01/0.03 | 0.00/0.01 | 0.02/0.05 | 0.04 |
| Example 10 | Toner (J) | 1.35/1.32 | 1.34/1.32 | 1.29/1.28 | 0.09/1.12 | 0.09/1.21 | 0.10/1.26 | 0.03 |
| Example 11 | Toner (K) | 1.35/1.31 | 1.32/1.30 | 1.29/1.27 | 0.09/1.15 | 0.10/1.23 | 0.12/1.29 | 0.03 |
| Example 12 | Toner (L) | 1.43/1.40 | 1.45/1.43 | 1.47/1.45 | 0.02/0.03 | 0.02/0.03 | 0.03/0.06 | 0.09 |
| Example 13 | Toner (M) | 1.41/1.37 | 1.44/1.42 | 1.43/1.42 | 0.03/0.04 | 0.02/0.03 | 0.04/0.07 | 0.09 |
| Example 14 | Toner (N) | 1.44/1.40 | 1.45/1.43 | 1.47/1.46 | 0.02/0.04 | 0.01/0.02 | 0.03/0.06 | 0.08 |

TABLE 5-continued

| | Toner | Image density | | | Fogging | | | Density |
|---|---|---|---|---|---|---|---|---|
| | | LL | NN | HH | LL | NN | HH | unevenness |
| Example 15 | Toner (O) | 1.43/1.40 | 1.46/1.44 | 1.42/1.38 | 0.02/0.03 | 0.01/0.03 | 0.04/0.10 | 0.06 |
| Example 16 | Toner (P) | 1.45/1.41 | 1.47/1.46 | 1.48/1.48 | 0.02/0.03 | 0.00/0.02 | 0.03/0.05 | 0.03 |
| Example 17 | Toner (Q) | 1.43/1.40 | 1.45/1.43 | 1.45/1.44 | 0.03/0.05 | 0.05/0.08 | 0.08/0.12 | 0.05 |
| Example 18 | Toner (R) | 1.44/1.42 | 1.48/1.45 | 1.47/1.46 | 0.02/0.04 | 0.01/0.03 | 0.02/0.06 | 0.02 |
| Example 19 | Toner (S) | 1.45/1.41 | 1.47/1.46 | 1.45/1.43 | 0.02/0.03 | 0.01/0.02 | 0.02/0.05 | 0.02 |
| Example 20 | Toner (T) | 1.33/1.30 | 1.30/1.25 | 1.28/1.25 | 0.56/1.26 | 0.33/1.55 | 0.30/1.45 | 0.12 |
| Example 21 | Toner (U) | 1.30/1.25 | 1.29/1.22 | 1.25/1.21 | 0.78/1.78 | 0.75/1.88 | 0.90/2.10 | 0.13 |
| Example 22 | Toner (V) | 1.28/1.20 | 1.26/1.22 | 1.24/1.21 | 0.80/1.90 | 0.79/1.96 | 1.23/2.32 | 0.14 |
| Example 23 | Toner (W) | 1.34/1.30 | 1.36/1.32 | 1.31/1.28 | 0.34/0.45 | 0.13/0.20 | 0.16/0.24 | 0.04 |
| Comparative Example 1 | Toner (a) | 1.28/1.21 | 1.24/1.15 | 1.15/1.14 | 0.82/0.89 | 0.92/0.95 | 1.88/3.12 | 0.06 |
| Comparative Example 2 | Toner (b) | 1.11/1.09 | 1.10/1.06 | 1.04/0.91 | 2.96/3.11 | 3.32/3.59 | 3.90/4.59 | 0.06 |
| Comparative Example 3 | Toner (c) | 1.15/1.12 | 1.14/1.09 | 1.10/1.00 | 2.99/3.78 | 2.78/3.33 | 2.15/2.56 | 0.06 |
| Comparative Example 4 | Toner (d) | 1.20/1.18 | 1.20/1.13 | 1.10/1.08 | 2.10/2.33 | 2.11/2.66 | 2.59/3.48 | 0.06 |
| Comparative Example 5 | Toner (e) | 1.23/1.17 | 1.24/1.15 | 1.12/1.11 | 1.85/2.15 | 1.56/1.90 | 1.34/2.58 | 0.07 |
| Comparative Example 6 | Toner (f) | 1.18/1.15 | 1.15/1.10 | 1.10/1.05 | 2.88/3.69 | 2.67/3.29 | 2.11/2.36 | 0.07 |
| Comparative Example 7 | Toner (g) | 1.25/1.22 | 1.22/1.13 | 1.10/1.08 | 2.12/2.56 | 2.23/2.66 | 3.23/4.12 | 0.06 |
| Comparative Example 8 | Toner (h) | 1.12/1.10 | 1.13/1.07 | 1.05/0.95 | 2.88/2.96 | 3.22/3.56 | 3.88/4.56 | 0.07 |
| Comparative Example 9 | Toner (i) | 1.09/1.01 | 1.08/0.96 | 0.96/0.88 | 3.12/3.23 | 3.53/3.69 | 4.10/4.88 | 0.06 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-100911, filed May 14, 2014 which is hereby incorporated by reference herein in its entirety.

What is claimed is:

1. A toner, comprising:

toner particles, said toner particles comprising resin particles fixed to toner base particles, the toner base particles each comprising resins and a colorant, wherein the resins comprise a styrene-acrylic resin and a polyester resin A, a content of the styrene-acrylic resin is 50.0 mass % or more with reference to the resins, a content of the polyester resin A is 1.0 to 40.0 mass % with reference to the resins, the styrene-acrylic resin has a peak molecular weight (Mp) of 5,000 to 30,000, the polyester resin A has a unit represented by formula (1), and a ratio of the unit represented by formula (1) is 0.10 to 30.00 number % with reference to the number of all units constituting the polyester resin A, (1)

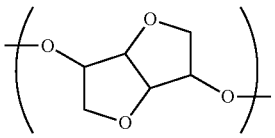

a fixing amount of the resin particles to the toner base particles is 0.1 to 5.0 parts by mass with respect to 100.0 parts by mass of the toner base particles, and glass transition temperature of the resin particles Tg2 (° C.) is higher than glass transition temperature of the toner base particles Tg1 (° C.).

2. A toner according to claim 1, wherein the polyester resin A has an acid value of 0.5 to 25.0 mgKOH/g.

3. A toner according to claim 1, wherein the glass transition temperature Tg2 (° C.) of the resin particles is 60.0 to 105.0° C.

4. A toner according to claim 1, wherein the glass transition temperature Tg1 (° C.) of the toner base particles is 50.0 to 58.0° C.

5. A toner according to claim 1, wherein the styrene-acrylic resin comprises a copolymer of styrene and butyl acrylate.

6. A toner according to claim 1, wherein the resin particles have a median diameter (D50) on a volume basis of 20 to 200 nm.

7. A toner according to claim 1, wherein the toner base particles are obtained by forming particles of a polymerizable monomer composition containing the resin A, the colorant, and polymerizable monomers in an aqueous medium, and polymerizing the polymerizable monomers, and the styrene-acrylic resin comprises a resin obtained from the polymerizable monomers.

* * * * *